US008514036B2

(12) United States Patent
McKinzie, III

(10) Patent No.: US 8,514,036 B2
(45) Date of Patent: Aug. 20, 2013

(54) APPARATUS AND METHOD FOR MODE SUPPRESSION IN MICROWAVE AND MILLIMETERWAVE PACKAGES

(75) Inventor: William E. McKinzie, III, Fulton, MD (US)

(73) Assignee: Wemtec, Inc., Fulton, MD (US)

( * ) Notice: Subject to any disclaimer, the term of this patent is extended or adjusted under 35 U.S.C. 154(b) by 1306 days.

(21) Appl. No.: 12/187,071

(22) Filed: Aug. 6, 2008

(65) Prior Publication Data

US 2009/0051467 A1 Feb. 26, 2009

Related U.S. Application Data

(60) Provisional application No. 60/964,680, filed on Aug. 14, 2007.

(51) Int. Cl.
*H01P 1/16* (2006.01)
*H01Q 15/02* (2006.01)

(52) U.S. Cl.
USPC ..... 333/251; 343/909; 333/175

(58) Field of Classification Search
USPC ..... 333/212, 251, 174, 175, 176; 343/909
See application file for complete search history.

(56) References Cited

U.S. PATENT DOCUMENTS

| | | | | |
|---|---|---|---|---|
| 4,268,803 | A | 5/1981 | Childs et al. | |
| 4,689,585 | A | 8/1987 | Sequeira | |
| 5,126,716 | A | 6/1992 | Munger | |
| 5,376,901 | A * | 12/1994 | Chan et al. | 333/33 |
| 5,481,232 | A | 1/1996 | Wu et al. | |
| 5,801,605 | A | 9/1998 | Filakovsky | |
| 6,262,495 | B1 | 7/2001 | Yablonovitch et al. | |
| 6,337,661 | B1 | 1/2002 | Kondoh et al. | |
| 6,580,395 | B2 | 6/2003 | Koshizaka et al. | |
| 6,710,745 | B2 | 3/2004 | Koshizaka et al. | |
| 6,756,932 | B1 | 6/2004 | Barker et al. | |
| 6,774,867 | B2 * | 8/2004 | Diaz et al. | 343/909 |
| 6,906,674 | B2 | 6/2005 | McKinzie, III et al. | |
| 6,919,862 | B2 * | 7/2005 | Hacker et al. | 343/909 |
| 6,949,707 | B1 | 9/2005 | Tonomura | |
| 6,967,282 | B2 | 11/2005 | Tonomura et al. | |

(Continued)

FOREIGN PATENT DOCUMENTS

| | | |
|---|---|---|
| JP | 2003008309 A | 1/2003 |
| JP | 2003-060101 | 2/2003 |
| JP | 2003304106 A | 10/2003 |
| WO | WO 94/00892 | 1/1994 |

OTHER PUBLICATIONS

Clavijo et al., "Design Methodology for Sievenpiper High-Impedance Surfaces: An Artificial Magnetic Conductor for Positive Gain Electrically Small Antennas", Oct. 2003, IEEE, vol. 51, No. 10, p. 2678-2690.*

(Continued)

*Primary Examiner* — Dean O Takaoka
*Assistant Examiner* — Alan Wong
(74) *Attorney, Agent, or Firm* — Brinks Hofer Gilson & Lione

(57) ABSTRACT

A parallel plate waveguide structure configured to suppress parallel-plate waveguide modes is described. The electromagnetic material properties of individual layers disposed between the conductive plates of waveguide may be selected to allow an apparent stopband to form. Several physical examples of electromagnetic bandgap (EBG) structures are presented that are analyzed by full wave simulations and transverse resonance models.

38 Claims, 26 Drawing Sheets

(56) References Cited

U.S. PATENT DOCUMENTS

| | | | | |
|---|---|---|---|---|
| 7,123,118 | B2 | 10/2006 | McKinzie, III | |
| 7,142,822 | B2 | 11/2006 | Tanaka et al. | |
| 7,157,992 | B2 | 1/2007 | McKinzie, III | |
| 7,197,800 | B2 | 4/2007 | Sievenpiper et al. | |
| 7,215,007 | B2 | 5/2007 | McKinzie, III et al. | |
| 7,239,222 | B2 | 7/2007 | Nagaishi et al. | |
| 7,250,835 | B2 | 7/2007 | Higgins et al. | |
| 7,342,471 | B2 | 3/2008 | McKinzie, III | |
| 7,414,491 | B2 | 8/2008 | Higgins | |
| 7,586,444 | B2 | 9/2009 | Berlin et al. | |
| 2005/0007289 | A1 | 1/2005 | Zarro et al. | |
| 2006/0038639 | A1 * | 2/2006 | McKinzie, III | 333/219 |
| 2008/0102565 | A1 | 5/2008 | Zeng et al. | |
| 2009/0244874 | A1 | 10/2009 | Mahajan et al. | |

OTHER PUBLICATIONS

Zadeh, A., et al., "Capacitive Circuit Method for Fast and Efficient Design of Wideband Radar Absorbers," IEEE Transactions on Antennas and Propagation, vol. 57, No. 8, Aug. 2009, pp. 2307-2314.

US 2007/0077401, 04/2007, Pinto (withdrawn).

Bongard, F., et al., "Enhanced Periodic Structure Analysis Based on a Multiconductor Transmission Line Model and Application to Metamaterials," IEEE Transactions on Microwave Theory and Techniques, vol. 57, No. 11, Nov. 2009, pp. 2715-2726.

Luukkonen, O., et al., "An Efficient and Simple Analytical Model for Analysis of Propagation Properties in Impedance Waveguides," IEEE Transactions on Microwave Theory and Techniques, vol. 56, No. 7, Jul. 2008, pp. 1624-1632.

Rotman, W., "Plasma Simulation by Artificial Dielectrics and Parallel-Plate Media," *IRE Transactions on Antennas and Propagation*, January, Authorized licensed use limited to: William Mckinzie, Downloaded on Dec. 10, 2009 at 14:46 from IEE Xplore, pp. 82-95, yr 1962.

Tretyakov, S., et al., "Thin composite radar absorber operational for all incidence angles," 33rd European Microwave Conference—Munich 2003, Authorized licensed use limited to: William Mckinzie, Downloaded on Oct. 27, 2009 at 12:40 from IEE Xplore, pp. 1107-1110, yr 2003.

International Search Report for International Application No. PCT/US2010/025396, dated Mar. 23, 2011, 5 pages.

Written Opinion of the International Searching Authority from the International Search Report from PCT application No. PCT/US2010/025396 dated Mar. 23, 2011, 6 pages.

Clavijo, S., et al., "Design Methodology for Sievenpiper High-Impedance Surfaces: An Artificial Magnetic Conductor for Positive Gain Electrically-Small Antennas," IEEE Transactions on Antennas and Propagation, vol. 51, No. 10, Oct. 2003, pp. 2678-2690.

PCT Notification of Transmittal of the International Preliminary Report on Patentability from PCT International Application No. PCT/US2008/073096 dated Feb. 16, 2010 (6 pages).

Abhari et al., "Suppression of the Parallel-Plate Noise in High Speed Circuits Using a Metallic Electromagnetic Band-Gap Structure," 2002 IEEE Microwave Theory and Techniques International Symposium, pp. 493-496.

Abhari et al., "Metallo-Dielectric Electromagnetic Bandgap Structures for Suppression and Isolation of the Parallel-Plate Noise in High Speed Circuits," IEEE, Trans. MTT, vol. 51, No. 6, Jun. 2003, pp. 1629-1639.

Elek et al., "Dispersion Analysis of the Shielded Sievenpiper Structure Using Multiconductor Transmission-Line Theory," IEEE Microwave and Wireless Components Letters, vol. 14, No. 9, Sep. 2004, pp. 434-436.

Ziroff et al., "A Novel Approach for LTCC Packaging Using a PBG Structure for Shielding and Package Mode Suppression," 33rd European Microwave Conference, Munich 2003, pp. 419-422.

Written Opinion of the International Searching Authority from the International Search Report from PCT application No. PCT/US2008/073096 dated Feb. 11, 2009, 4 pages.

International Search Report for International Application No. PCT/US2008/073096, dated Feb. 11, 2009, 3 pages.

Sievenpiper, Daniel Frederic, "High-Impedance Electromagnetic Surfaces," University of California, Los Angeles, 1999, pp. 1-4.

Response to Final Office Action filed Oct. 18, 2012, for related U.S. Appl. No. 12/711,923.

* cited by examiner

Design parameters:
P = 500 um, square lattice
$s_1 = s_2 = 390$ um
$s_3 = s_4 = 390$ um
$t_1 = t_5 = 300$ um
$t_3 = 1000$ um
$t_2 = t_4 = 25$ um
$d_1 = 90$ um square via
$\varepsilon_{r2} = \varepsilon_{r4} = 10$
$\varepsilon_{r1} = \varepsilon_{r5} = 6$
$\mu_{ri} = 1$ for $i = 1, 2, 4$, and 5

APPARATUS AND METHOD FOR MODE SUPPRESSION IN MICROWAVE AND MILLIMETERWAVE PACKAGES

RELATED APPLICATIONS

This application claims priority to U.S. Provisional application Ser. No. 60/964,680, filed on Aug. 14, 2007, which is incorporated herein by reference.

TECHNICAL FIELD

The field of the invention relates generally to systems and methods for suppressing the propagation of electromagnetic waves in parallel plate structures and, more particularly, to suppress parasitic modes, spurious modes, or electromagnetic noise in microwave and millimeterwave packages.

BACKGROUND

FIG. 1(*a*) illustrates a generic microwave or millimeterwave integrated circuit (MMIC) package fabricated as a shielded package and containing at least two microstriplines 140 and 150. This package also includes a cover 110 and a substrate 120 with conductive sidewalls 165 which, when sealed together with a conductive seal 130, create an enclosed cavity 115 of sufficient volume to accommodate one or more MMICs. The substrate and cover are dielectric materials of relative permittivity $\in_{r5}$ and $\in_{r1}$ respectively. The cavity formed therebetween may be an air filled region where the permittivity of the air is denoted as $\in_0$. Package materials may include semiconductors (Si, SiGe, GaAs), ceramics (Al2O3, AlN, SiC, BeO), metals (Al, Cu, Au, W, Mo), and metal alloys (FeNiCo (Kovar), FeNiAg (SILVAR), CuW, CuMo, Al/SiC) and many others. The substrate and cover need not be made of the same materials.

The package may be shielded with conductive surfaces 160, 170 to prevent radiation from internal sources (transmitters) and to protect internal receivers from undesired coupling with fields external to the package. The conductive surfaces 160, 170 form a parallel-plate waveguide (PPW) that allows a quasi-TEM (transverse electromagnetic) mode to be supported inside the package. The TEM mode has a vertical (z-directed) electric field which propagates in any x or y direction inside the package, and has a phase velocity of $(\omega/c)\sqrt{\epsilon_{eff}}$ where $\omega$ is the angular frequency, c is the speed of light in a vacuum; and, the effective dielectric constant of the PPW is given by $$\varepsilon_{eff} = \frac{t_1 + t_3 + t_5}{t_1/\varepsilon_{r1} + t_3 + t_5/\varepsilon_{r5}}$$

where $t_1$, $t_3$, and $t_5$ are the thicknesses of the cover, air region, and substrate, respectively. A parasitic or unintentional PPW mode is generated at discontinuities of the microstriplines such as at ends, gaps, and bends. This results in crosstalk between otherwise isolated microstriplines. The parasitic mode will also reflect at the sides of the package and result in undesired package resonances or parasitic resonances. Package resonances may exist at frequencies near $$f_{nm} = \frac{c}{2\pi\sqrt{\varepsilon_{eff}}}\sqrt{\left(\frac{m\pi}{W}\right)^2 + \left(\frac{n\pi}{L}\right)^2}$$

where W and L are the width and length of the rectangular package.

A conventional means of suppressing the parasitic resonances is to add lossy ferrite-loaded materials as thin layers inside the package. This is a relatively expensive method of mode suppression. Also, the ferrite layers need to be adhesively attached to a conductive surface to obtain the expected attenuation, and conducting surfaces may not be readily available inside of every package. Millimeterwave packages tend to be very small which exacerbates the assembly challenges of installing ferrite-loaded materials.

SUMMARY

An apparatus for controlling parallel-plate waveguide (PPW) modes is described, having a first conductive surface, and a second conductive surface, disposed parallel to the first conductive surface; a first anisotropic magneto-dielectric layer comprising a first sub-layer and a second sub-layer; an isotropic dielectric layer, where the first anisotropic magneto-dielectric layer and the isotropic dielectric layer are disposed between the first conductive surface and the second conductive surface. Such a structure may be used to design and fabricate a MMIC package that capable of suppressing parasitic resonances over at least some desired frequency band while serving as a shielded package for EMI (electromagnetic interference) and EMC (electromagnetic compatibility).

In an aspect, an apparatus for controlling parallel-plate waveguide (PPW) modes may have a first and a second conductive surface sized and dimensioned to form a parallel plate waveguide (PPW); and a first and a second dielectric layer disposed in the PPW, where at least one of the dielectric layers includes an array of conductive obstacles.

In another aspect, an electromagnetic bandgap structure includes a dielectric slab having a conductive surface on one surface thereof; and an array of conductive vias embedded in the dielectric slab; and, where the vias have a non-uniform cross sectional shape and are connected to the conductive surface.

A two-dimensional layered magneto-dielectric structure forming a package may control PPW mode propagation within the package by creating an electromagnetic bandgap (EBG). In an aspect, such structures may act as a distributed omni-directional microwave or millimeterwave (MMW) bandstop filter to suppress the PPW mode over a desired frequency range. The attenuation properties of the EBG structure may be controlled by the tensor permittivity and tensor permeability values of the individual magneto-dielectric layers. For example, a stopband may be achieved for frequencies well below the Bragg scattering limit frequency by designing the magneto-dielectric sublayers closest to the parallel plates to have a negative normal permittivity value and by designing the next innermost sublayers to have a high and positive transverse permittivity values. The Bragg scattering limit is the frequency at which the spacing of periodic obstacles in layers of the PPW are separated by a distance of about $\lambda/(2\sqrt{\epsilon_{eff}})$ where $\lambda$ is the free space wavelength or, equivalently, where the electrical length between adjacent periodic obstacles is about 180°.

In some aspects, the magneto-dielectric layers may be ordered or periodic arrangements of metal and dielectric materials. In an aspect where some layers are comprised of periodic obstacles in the PPW, the lateral distance between obstacles may be substantially less than a guide wavelength $\lambda_g$ where $\lambda_g=\lambda/\sqrt{\epsilon_{eff}}$.

In other aspects, the magneto-dielectric layer may be conductive vias, connected to one of the conductive parallel plates, where the vias have non-uniform cross sectional shapes. Such non-uniform vias may be formed by combining or connecting higher aspect ratio vias with lower aspect ratio vias. An example of a non-uniform via is a right circular cylindrical via that terminates in the base of a rectangular cavity that is open at the top. Another example may be a right circular cylindrical via that connects to a pyramidal via whose pyramidal base is open at the top.

In yet another aspect, the parallel-plate waveguide (PPW) may contain an EBG structure comprised of two magneto-dielectric layers with at least one isotropic dielectric layer disposed therebetween. The magneto-dielectric layers may be disposed adjacent to the conductive planes inside the PPW. The isotropic dielectric layer located between the magneto-dielectric layers may be, for example, an air gap as may be found within a microwave or millimeterwave package. The first magneto-dielectric layer may be part of the base of the package, and the second magneto-dielectric layer may be part of the lid or cover of the package.

A method for controlling parallel-plate waveguide (PPW) modes is disclosed, including: providing a first conductive surface, and a second conductive surface, disposed parallel to the first conductive surface; and the first conductive surface and the second conductive surface form a part of a electronic circuit package. Providing a first anisotropic magneto-dielectric layer having a first sub-layer and a second sub-layer and an isotropic dielectric layer where the first anisotropic magneto-dielectric layer and the isotropic dielectric layer are disposed between the first conductive surface and the second conductive surface; and selecting the thickness of the first sub-layer and the second sub-layer, the permittivity and permeability of the first sub-layer and the second sub-layer, and the thickness and dielectric constant of the isotropic dielectric layer such that a transverse magnetic (TM) wave amplitude is suppressed over a frequency interval.

A method for controlling parallel-plate waveguide (PPW) modes in a shielded electronic package is disclosed, including: providing a first and a second conductive surface sized and dimensioned to form part of an electronic circuit package. Disposing a first and a second dielectric layer between the first and second conductive surfaces, where at least one of the dielectric layers including an array of conductive obstacles having a non-uniform cross-sectional shape; and, selecting the dimensions of the conductive obstacles such that the propagation of a transverse magnetic (TM) wave is controlled in at least one of amplitude or phase over a frequency interval.

DETAILED DESCRIPTION

Reference will now be made in detail to several examples; however, it will be understood that claimed invention is not limited to such examples. Like numbered elements in the same or different drawings perform equivalent functions. In the following description, numerous specific details are set forth in the examples in order to provide a thorough understanding of the subject matter of the claims which, however, may be practiced without some or all of these specific details. In other instances, well known process operations or structures have not been described in detail in order not to unnecessarily obscure the description.

When describing a particular example, the example may include a particular feature, structure, or characteristic, but every example may not necessarily include the particular feature, structure or characteristic. This should not be taken as a suggestion or implication that the features, structure or characteristics of two or more examples should not or could not be combined, except when such a combination is explicitly excluded. When a particular feature, structure, or characteristic is described in connection with an example, a person skilled in the art may give effect to such feature, structure or characteristic in connection with other examples, whether or not explicitly described.

Figure 1:
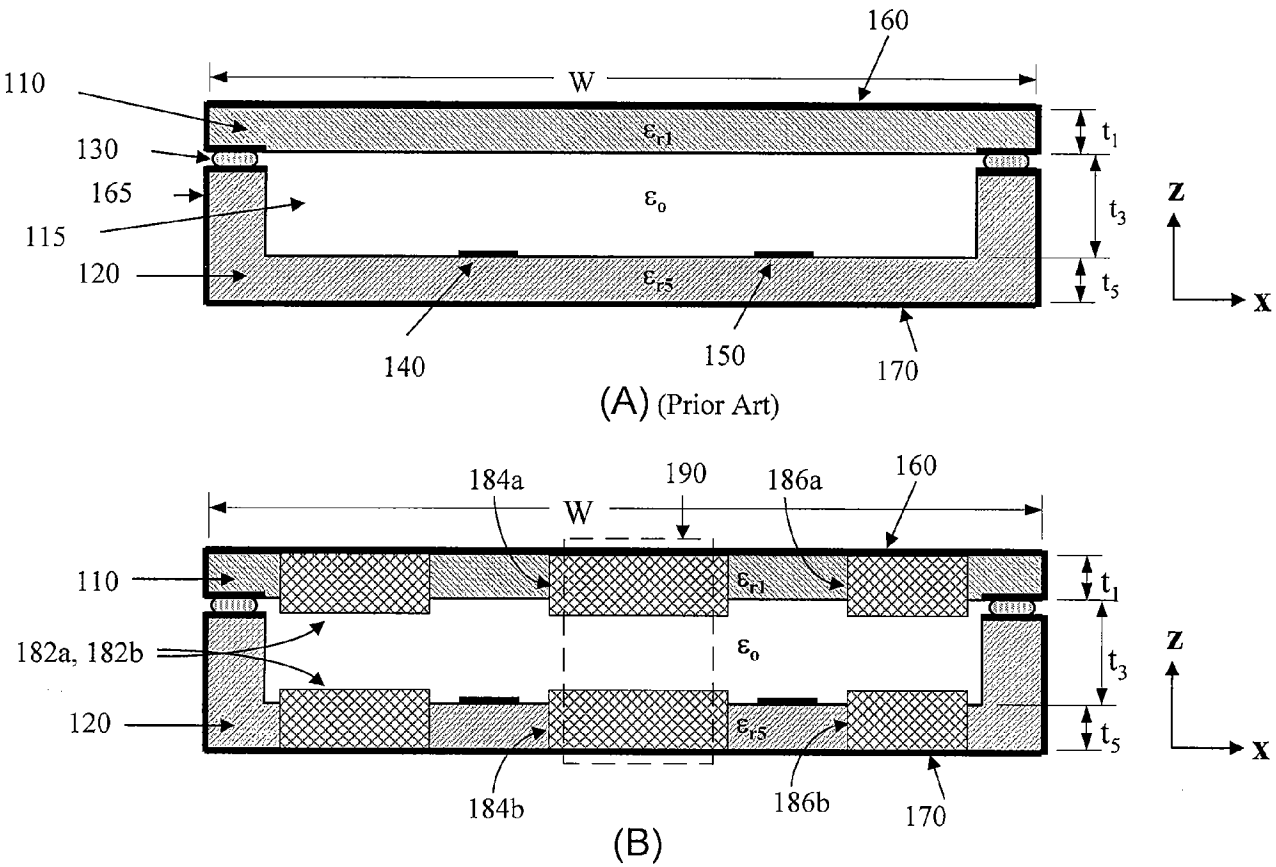
FIG. 1 shows cross sectional views of a shielded microwave package with internal microstriplines (a) as in the prior art, and (b) with EBG structures of a first example.

FIG. 1(*b*) is a MMIC package that is the same as that shown in FIG. 1(*a*) but with the addition of electromagnetic bandgap (EBG) structures 182, 184, and 186. The package has a cover 110, a substrate 120 and a cavity 115, plus microwave or millimeterwave transmission lines such as microstriplines 140 and 150, and other components of a MMIC that are not shown. Also included in the package are conductive surfaces 160 and 170 which may be electromagnetic shields for EMI and EMC purposes. However, such conductive surfaces also guide parallel-plate waveguide (PPW) modes therebetween. Such modes may be termed parasitic modes because they may promote undesired crosstalk or coupling between the transmission lines and because they may create cavity resonances within the package. The EBG structures 182, 184, and 186 may be incorporated in the package to suppress the PPW modes over certain frequencies ranges.

The EBG structures in FIG. 1(*b*) may be fabricated as part of the substrate such as 184*b*, or as part of the cover such as 184*a*. The EBG structures may function as a pair, and cooperate to determine the EBG, which may also be called the stopband. Between the EBG structures 184*a* and 184*b* there may be a cavity region which may be air filed as shown, or an isotropic dielectric such as a molding compound. A portion of the package containing EBG structures 184*a* and 184*b*, the conductive surfaces 160 and 170, and the cavity region between them may be considered to be an inhomogeneous PPW 190. The inhomogeneous PPW 190 may allow an EBG to be realized.

Herein, a PPW is considered to be a pair of parallel conductive planes whose area is sufficient to encompass at least a 3×3 array of unit cells associated with an EBG structure. These parallel planes may have holes or voids in the conductive surfaces thereof, but such holes or voids should not have an area greater than about one fourth of the area of a given unit cell so as to have a small influence on the local value of the stopband properties of the EBG structure. A person of skill in the art will appreciate that such holes, voids or apertures may be needed in to accommodate the circuitry and other structures which may be part of a MMIC package. The figures and descriptions herein therefore may be considered to represent an ideal situation, which may be adapted to the design of specific product. When a coupling or radiating slot is introduced into one of the conductive planes of the PPW, one may improve the efficiency of microwave or millimeterwave transitions and the efficiency of slot radiators. The height of the PWW may be reduced without heavy excitation of PPW modes which may have the effect of lowering efficiency.

Five Layer Effective Medium Model of the Inhomogeneous PPW

Figure 2:
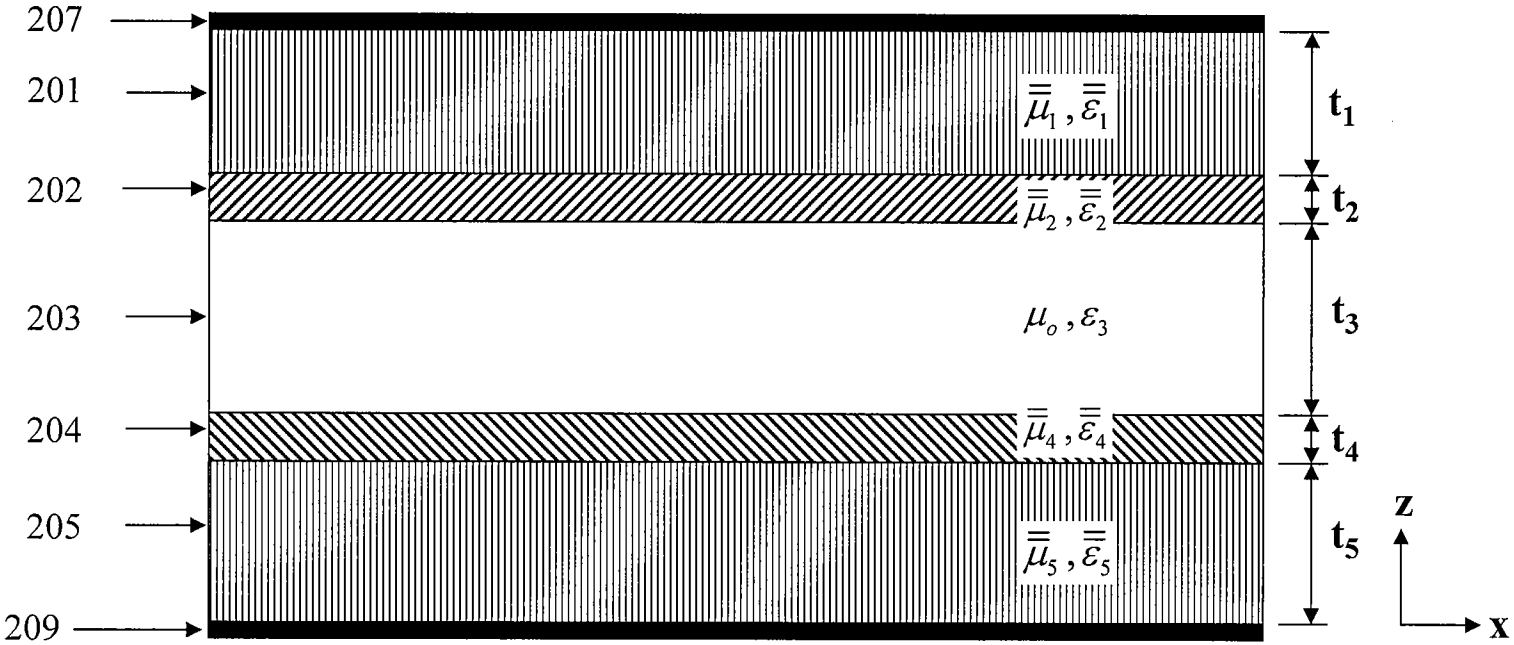
FIG. 2 shows an effective medium model for one example.

FIG. 2 illustrates an inhomogeneous parallel-plate waveguide (PPW) 190. The inhomogeneous PPW may contain anisotropic magneto-dielectric layers 201, 202, 204, and 205 in which the permittivity and permeability may be mathematically described as tensors. Layer 203 may be an isotropic dielectric layer of relative permittivity $\in_3$, and, in some examples, this layer may be an air gap where $\in_3=1$. The layers are contained between the upper conductor 207 and the lower conductor 209 such that the internal electromagnetic fields are effectively confined between upper and lower conductors.

For computation and description of the examples, a coordinate system is used in which the in-plane directions are the x and y Cartesian coordinates, and the z axis is normal to the layered structure.

Each magneto-dielectric layer in FIG. 2 may have a unique tensor permittivity $\overline{\overline{\in}}$ and a unique tensor permeability $\overline{\overline{\mu}}$. The tensor permittivity and tensor permeability of each layer may have non-zero elements on the main diagonal, with the x and y tensor directions being in-plane with each respective layer, and the z tensor direction being normal to the layer interface.

In this analytic model, which may be termed an effective medium model of FIG. 2, each magneto-dielectric layer is a bi-anisotropic media: both the permeability $\overline{\overline{\mu}}$ and the permittivity $\overline{\overline{\in}}$ are tensors. Furthermore, each magneto-dielectric layer may be uniaxial: that is, two of the three main diagonal components are equal, and off-diagonal components are zero, for both $\overline{\overline{\mu}}$ and $\overline{\overline{\in}}$. Each layer 201, 202, 204, and 205 may be considered a bi-uniaxial media where the equal tensor components of the main diagonals are in the transverse direction.

FIG. 2 termed is an effective medium model, meaning that individual layers are modeled as homogeneous such that, in the long wavelength limit (as the guide wavelength becomes long with respect to the unit cell dimensions), the tensor permittivity and permeability of the individual layers accurately model the physical structure which may be periodic.

If the PPW of FIG. 2 were to be filled with an isotropic homogeneous dielectric material, the dominant electromagnetic propagation mode would be a transverse electromagnetic (TEM) mode that has a uniform z-directed E field and a uniform y-directed H field, assuming propagation in the x direction. However, as depicted in FIG. 2 the structure is an inhomogeneously-filled waveguide which will support both TM-to-x and TE-to-x modes. At low frequencies, the lowest order TM mode may resemble the ideal TEM mode. TM modes have normal (z-directed) E fields. The z-directed E field may be excited by discontinuities in printed transmission lines. The electromagnetic coupling, or the reaction integral, between the fields associated with transmission line discontinuities and the fields associated with intrinsic modes of the inhomogeneous PPW, is enhanced when the total thickness of the waveguide is decreased. In practice, MMIC packages may be designed to be as thin as physically possible, consistent with industrial designs. However, this may increase the importance of suppressing unwanted electromagnetic coupling.

For the inhomogeneous PPW of FIG. 2, magneto-dielectric layers 201 and 205 may be defined to have the normal (z direction) permittivity which behaves like a plasma for z-directed E fields. In these layers, the z-tensor-component of relative permittivity $\in_{iz}$ for i=1 and 5 is negative for frequencies from DC up to the plasma frequency of $\omega_p$. The plasma frequency may be determined by controlling the period of the unit cells and the diameter of the metallic vias in accordance with equation (27), as described below. Above the plasma frequency, $\in_{zi}$ is positive and becomes asymptotic at high frequency to the permittivity value of the host or background medium, defined as $\in_{ri}$ Let $$\varepsilon_{zi}(\omega) = \varepsilon_{ri}\left[1 - \left(\frac{\omega_p}{\omega}\right)^2\right] \text{ for } i = 1 \text{ and } 5. \tag{1}$$

Also, $\in_{zi}$ for i=1 and 5 may be negative over a range of frequencies that includes the stopband of the EBG structure. The transverse tensor components $\in_{xi}$ and $\in_{yi}$ may have permittivity values near the host or background medium $\in_{ri}$. The non-zero components of tensor permeability, $\mu_{xi}$, $\mu_{yi}$, and $\mu_{zi}$ for i=1 and 5 may have values near the host or background medium permeability defined as $\mu_{ri}$ for layers i=1 and 5. For nonmagnetic host media, $\mu_{ri}$=1.

The anisotropic magneto-dielectric layers 202 and 204 may be characterized by a high transverse capacitance $C_i$ where i=2 and 4. The transverse permittivity of layers 202 and 204 may be expressed as $\in_{xi}=\in_{yi}=C_i/(\in_0 t)>>1$. Note that these two layers may be chosen by design to have a relative transverse permittivity that is substantially greater than unity. To simplify the description herein, we shall assume that the transverse capacitances in layers 202 and 204 are substantially constant, but this is not intended to be a limitation. In general, the transverse capacitance may be frequency dependent and defined as $Y_i=j\omega C_i$ where $Y_i$ is a admittance function expressed in a second Foster canonical form as taught by Diaz and McKinzie in U.S. Pat. No. 6,512,494, U.S. Pat. No. 6,670,932, and U.S. Pat. No. 6,774,867, which are incorporated herein by reference.

Magneto-dielectric layers 202 and 204 may have a normal permittivity $\in_{zi}$ for i=2 and 4 substantially equal to unity. The layers may also have relative transverse permeability $\mu_{xi}$ and $\mu_{yi}$ which is also close to unity. However, as a consequence of the desired high transverse permittivity $\in_{trans,i}$, the normal permeability may be depressed in these layers. This is because layers 202 and 204 model physical layers having conductive inclusions introduced to create high electric polarization in the transverse directions. However, these inclusions allow eddy currents to flow thereon in the x-y plane, which may suppress the ability of magnetic flux to penetrate in the normal direction. Hence, $$\mu_{zi} \cong \frac{2\varepsilon_{avg}}{\varepsilon_{trans,i}} << 1$$

where $\in_{trans,i}=\in_{xi}=\in_{yi}>>1$, and $\in_{avg}$ is the average relative dielectric constant of the host media for layers 202 and 204. If layers 202 and 204 model arrays of thin coplanar patches, then the parameter $\in_{avg}$ may be approximately the arithmetic average of the host relative dielectric constants on either side of the coplanar patches. If the inclusions modeled as layers 202 and 204 are more elaborate and have physical extent in the z direction, then $\in_{avg}$ may be as large as the host or background dielectric material located between the inclusions. The mathematical differences for simulation may not change the analysis procedure used to determine the fundamental stopband. Both cases will be shown in later examples.

The desired electromagnetic constituent parameters of the magneto-dielectric layers 201, 202, 204, and 205 of FIG. 2, may be expressed as:

$$\bar{\bar{\varepsilon}}_i = \begin{bmatrix} \varepsilon_{xi} & 0 & 0 \\ 0 & \varepsilon_{yi} & 0 \\ 0 & 0 & \varepsilon_{zi} \end{bmatrix} = \begin{bmatrix} \cong \varepsilon_{ri} & 0 & 0 \\ 0 & \cong \varepsilon_{ri} & 0 \\ 0 & 0 & \varepsilon_{ri}\left[1 - \left(\frac{\omega_p}{\omega}\right)^2\right] \end{bmatrix} \tag{2}$$

for $i = 1$ and 5, $$\bar{\bar{\mu}}_i = \begin{bmatrix} \mu_{xi} & 0 & 0 \\ 0 & \mu_{yi} & 0 \\ 0 & 0 & \mu_{zi} \end{bmatrix} = \begin{bmatrix} \cong \mu_{ri} & 0 & 0 \\ 0 & \cong \mu_{ri} & 0 \\ 0 & 0 & \cong \mu_{ri} \end{bmatrix} \tag{3}$$

for $i = 1$ and 5, $$\bar{\bar{\varepsilon}}_i = \begin{bmatrix} \varepsilon_{xi} & 0 & 0 \\ 0 & \varepsilon_{yi} & 0 \\ 0 & 0 & \varepsilon_{zi} \end{bmatrix} = \begin{bmatrix} \frac{C_i}{\varepsilon_o t_i} & 0 & 0 \\ 0 & \frac{C_i}{\varepsilon_o t_i} & 0 \\ 0 & 0 & \cong \varepsilon_{ri} \end{bmatrix} \text{ for } i = 2 \text{ and } 4, \tag{4}$$

$$\bar{\bar{\mu}}_i = \begin{bmatrix} \mu_{xi} & 0 & 0 \\ 0 & \mu_{yi} & 0 \\ 0 & 0 & \mu_{zi} \end{bmatrix} = \begin{bmatrix} \cong \mu_{ri} & 0 & 0 \\ 0 & \cong \mu_{ri} & 0 \\ 0 & 0 & \frac{2\varepsilon_{avg}}{\varepsilon_{trans,i}} \end{bmatrix} \tag{5}$$

for $i = 2$ and 4,

Where, for all four layers, $\in_{ri}$ is typically between about 2 and about 10, and $\mu_{ri}$ is typically unity. For layers 202 and 204, the transverse relative permittivity $\in_{i,trans}=C_i/(\in_0 t_i)$ may be between about 100 and about 3000.

To calculate the existence of TM mode stopbands within the inhomogeneous PPW of FIG. 2, one may use the transverse resonance method (TRM). The TRM is a mathematical technique used to predict the complex propagation constant in the x direction, $k_x$, as a function of frequency. Each layer is modeled as an equivalent transmission line (TL), where the impedance along the line is the ratio of the transverse electric field $E_x$ to the transverse magnetic field $H_y$, assuming a TM mode and propagation in the x direction. Where the magneto-dielectric layers are assumed uniaxial, electromagnetic mode propagation in the y direction has the same properties to that of the x direction.

Figure 3:
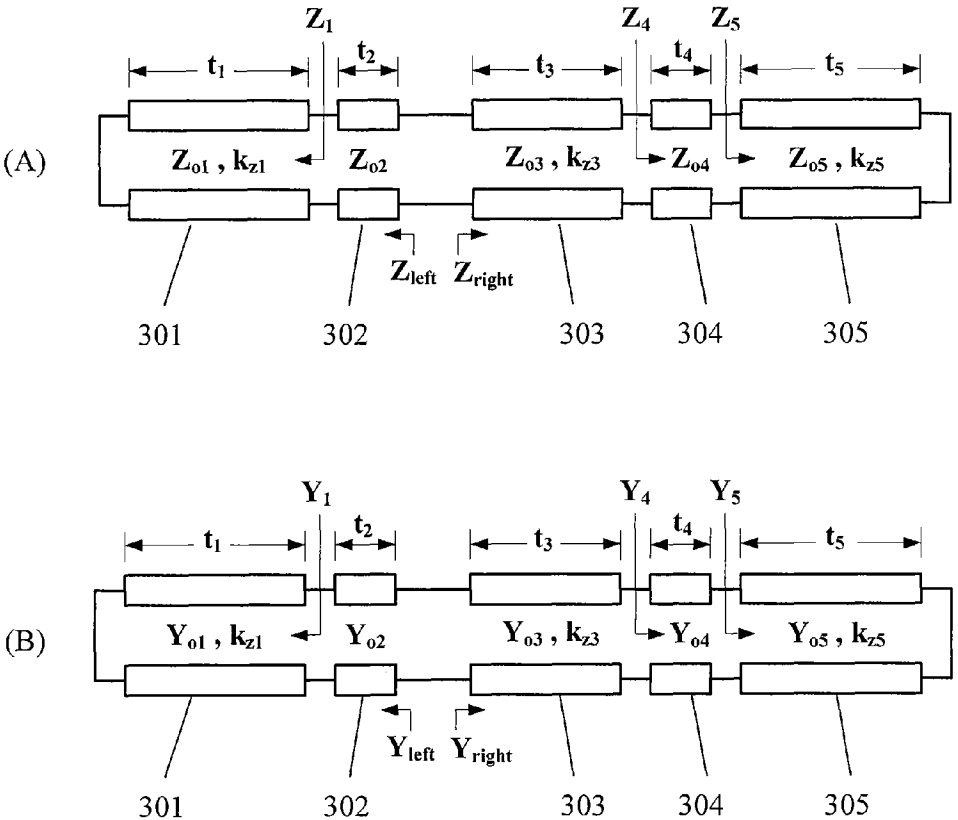
FIG. 3 is an equivalent circuit model using transmission lines to represent the effective medium layers shown in FIG. 2.

The equivalent transmission line (TL) model for the inhomogeneous PPW of FIG. 2 is shown in FIGS. 3(*a*) and 3(*b*). This equivalent circuit is comprised of five contiguous TLs, one for each layer shown in FIG. 2. Short circuits on both ends (left and right) represent the upper and lower conductors 207 and 209 respectively. Transmission lines 301, 302, 303, 304, and 305 are used to model transverse electric field $E_x$ and the transverse magnetic field $E_x$ in layers 201, 202, 203, 204, and 205, respectively. At any reference plane along the multi-section transmission line model, $E_x$ and $H_y$ is continuous. This also means that the impedance, the ratio of $E_x/H_y$, is continuous. Continuity of the impedance leads directly to the fundamental transverse resonance relationship, which is:

$$Z_{left}(\omega)+Z_{right}(\omega)=0. \tag{6}$$

The roots of the transverse resonance equation yield the modal propagation constant $k_x$ which may be real, imaginary, or complex. The transverse resonance equation may be applied at any reference plane along the multi-section TL, and for example, the transverse resonance plane may be the interface between TL 302 and TL 303, for mathematical convenience. For TM-to-x modes, the impedance $E_x/H_y$ may be written as $$Z_{oi} = \frac{k_{zi}}{\omega\varepsilon_o\varepsilon_{xi}}, \quad \text{for } i = 1, 2, 3, 4 \text{ and } 5. \tag{7}$$

where $k_{zi}$ is the frequency dependent propagation constant in the normal or z direction:

$$k_{zi}(\omega, k_x) = \sqrt{\left(\frac{\omega}{c}\right)^2 \varepsilon_{xi}\mu_{yi} - k_x^2 \frac{\varepsilon_{xi}}{\varepsilon_{zi}}}, \text{ for } i = 1, 2, 4 \text{ and } 5. \tag{8}$$

For the isotropic dielectric layer 203, the z-directed propagation constant reduces to $$k_{z3}(\omega, k_x) = \sqrt{\left(\frac{\omega}{c}\right)^2 \varepsilon_{x3} - k_x^2}. \tag{9}$$

From equations (7) through (9) the TM mode impedances $Z_{left}(\omega)$ and $Z_{right}(\omega)$ are:

$$Z_{left}(\omega) = Z_{o2}\frac{Z_1\cos(k_{z2}t_2) + jZ_{o2}\sin(k_{z2}t_2)}{Z_{o2}\cos(k_{z2}t_2) + jZ_1\sin(k_{z2}t_2)} \tag{10}$$

where $$Z_1(\omega) - jZ_{o1}\tan(k_{z1}t_1) \tag{11}$$

and $$Z_{right}(\omega) = Z_{o3}\frac{Z_4\cos(k_{z3}t_3) + jZ_{o3}\sin(k_{z3}t_3)}{Z_{o3}\cos(k_{z3}t_3) + jZ_4\sin(k_{z3}t_3)} \tag{12}$$

where $$Z_4(\omega) = Z_{o4}\frac{Z_5\cos(k_{z4}t_4) + jZ_{o4}\sin(k_{z4}t_4)}{Z_{o4}\cos(k_{z4}t_4) + jZ_5\sin(k_{z4}t_4)} \tag{13}$$

$$Z_5(\omega) = jZ_{o5}\tan(k_{z5}t_5). \tag{14}$$

To predict the existence of TE modes within the inhomogeneous PPW of FIG. 2, one may also use the TRM. FIG. 3(*b*) shows the same transmission line equivalent circuit as FIG. 3(*a*) but where the impedances are expressed as admittances. For TE-to-x modes, the admittance $H_x/E_y$ may be written as $$Y_{oi} = \frac{k_{zi}}{\omega\mu_o\mu_{xi}} \quad \text{for } i = 1, 2, 3, 4 \text{ and } 5. \tag{15}$$

For TE waves, the z-directed propagation constants are:

$$k_{zi}(\omega, k_x) = \sqrt{\left(\frac{\omega}{c}\right)^2 \varepsilon_{yi}\mu_{xi} - k_x^2 \frac{\mu_{xi}}{\mu_{zi}}} \quad \text{for } i = 1, 2, 4 \text{ and } 5. \tag{16}$$

and $$k_{z3}(\omega, k_x) = \sqrt{\left(\frac{\omega}{c}\right)^2 \varepsilon_{y3} - k_x^2} \quad \text{for } i = 3. \tag{17}$$

The transverse resonance equation may equivalently be expressed using admittances as $$Y_{left}(\omega) + Y_{right}(\omega) = 0. \tag{18}$$

From equations (15) through (17) one may calculate the TE mode admittances $Y_{left}(\omega)$ and $Y_{right}(\omega)$:

$$Y_{left}(\omega) = Y_{o2}\frac{Y_1\cos(k_{z2}t_2) + jY_{o2}\sin(k_{z2}t_2)}{Y_{o2}\cos(k_{z2}t_2) + jY_1\sin(k_{z2}t_2)} \tag{19}$$

where $$Y_1(\omega) = -jY_{o1}\cot(k_{z1}t_1) \tag{20}$$

and $$Y_{right}(\omega) = Y_{o3}\frac{Y_4\cos(k_{z3}t_3) + jY_{o3}\sin(k_{z3}t_3)}{Y_{o3}\cos(k_{z3}t_3) + jY_4\sin(k_{z3}t_3)} \tag{21}$$

where $$Y_4(\omega) = Y_{o4}\frac{Y_5\cos(k_{z4}t_4) + jY_{o4}\sin(k_{z4}t_4)}{Y_{o4}\cos(k_{z4}t_4) + jY_5\sin(k_{z4}t_4)} \tag{22}$$

$$Y_5(\omega) = -jY_{o5}\cot(k_{z5}t_5) \tag{23}$$

Example A

An EBG Structure after FIG. 2 with Overlay Capacitors

Figure 4:
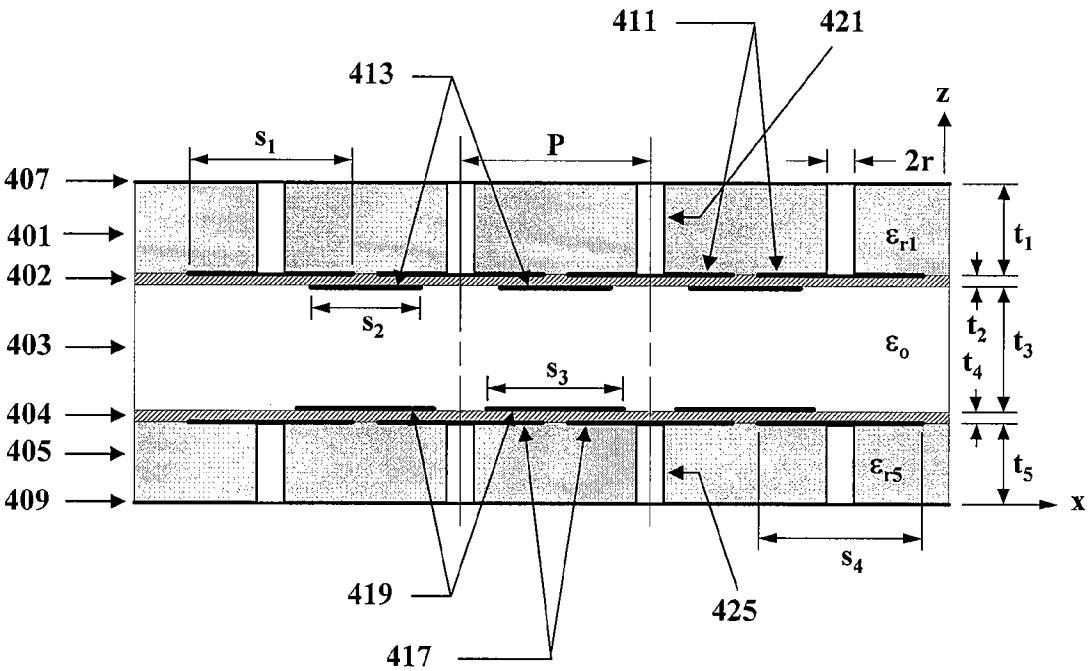
FIG. 4 illustrates an example as an EBG structure with overlay capacitors.

To illustrate the use of the effective media model shown in FIG. 2, an example is analyzed by comparing a full-wave analysis to the TRM using the effective media model for the EBG structure of FIG. 4. This is an inhomogeneous PPW containing upper and lower conducting planes 407 and 409, respectively. The periodic structures contained therein have a square lattice of period P. The square lattice is not a limitation, as other lattices, such as triangular, hexagonal, or circular, may be used. This example has a rodded medium in dielectric layers and 405 which is represents a periodic array of conductive vias 421 that connect the upper conducting plane to upper conductive patches 411 located at the interface between layers 401 and 402, and vias 425 that extend from the lower conducting plane to lower conductive patches 417 located at the interface between layers 404 and 405. These two rodded mediums in host dielectric layers 401 and 405 have a negative z-axis permittivity in the fundamental stopband, which will be described in greater detail below. The relatively thin dielectric layer 402, the upper conductive patches 411, and the upper conductive overlay patches 413 may be selected to exhibit a high effective transverse permittivity, which may be much greater than unity, for layer 202 in the effective media model. Similarly, dielectric layer 404, the lower conductive patches 417, and the lower conductive overlay patches 419 may be selected to exhibit a high relative transverse permittivity, also much greater than unity, for layer 204 in the effective media model. In this example, there is an air gap 403 between dielectric layers 402 and 404. Thicknesses of the five dielectric layers 401 through 405 are correspondingly denoted as $t_1$ through $t_5$. The relative dielectric constant of the host dielectric media for layers 401 through 405 is denoted as $\in_{ri}$ through $\in_{r5}$, where $\in_{r3}=1$ for the air gap.

In FIG. 4 the patches are square in shape, although any polygonal shape may be used. Patches 411 and 417 may be centered on the vias, while patches 413 and 419 may be centered on the gaps between the vias. Vias 421 and 425 are conducting rods, and they may be uniform circular cylinders of radius r as in this example. However, any cross sectional shape of via may be used and the cross sections may differ, for example, between upper and lower rodded mediums. The conductive vias may, for example, be fabricated as shells that are filled with a conductor or insulator, to achieve a hermetic seal for the package, but such filling is not necessary to obtain an electromagnetic bandgap. The vias 421 and 425 may have a central axis which is aligned between dielectric layer 401 and dielectric layer 405, however, this is not a limitation as the vias may be offset by any distance and the effective media model will be unchanged.

Vias 421 and 425 are illustrated as blind vias that terminate on patches closest to the conducting 407 and 409. Alternatively, these vias may be through vias that connect to the overlay patches 413 and 419, in which case the vias would not be electrically connected to patches 411 and 417. The transverse relative permittivity $\in_{i,trans}=C_i/(\in_0 t_i)$ for layers 202 and 204 may remain unchanged under these conditions.

Figure 5:
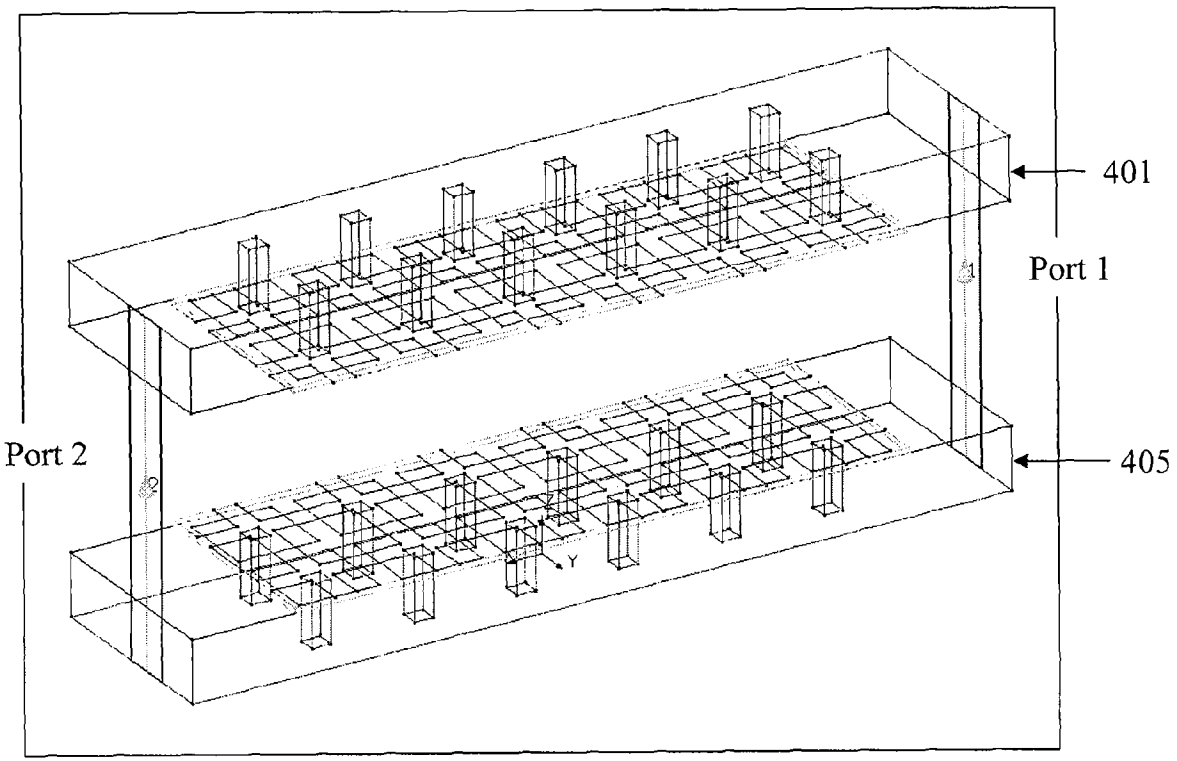
FIG. 5 shows a three-dimensional (3D) wire frame model used in a full-wave electromagnetic simulation of the EBG structure of FIG. 4.

This example of an EBG structure has been simulated using Microstripes™, a three dimensional (3D) electromagnetic simulator licensed from Flomerics in Marlborough, Mass. A wire frame view of the solid model used is illustrated in FIG. 5. This 3D model has TM mode waveguide ports on each end for power transmission calculations. The electric field of the TM mode is vertically polarized (z direction) as indicated by the arrowheads at each port. Between the ports lie a series of six unit cells of the EBG structure. In this 3D model, thicknesses and dielectric constants are selected to be typical of an LTCC (Low Temperature Co-fired Ceramic) package design. Specifically: P=500 um with a square lattice, $s_1=s_2=s_3=s_4=390$ um, $t_1=t_5=300$ um, $t_2=t_4=25$ um, $t_3=1000$ um, $\in_{r1}=\in_{r5}=6$, and $\in_{r2}=\in_{r4}=10$. The modeled vias are 90 um square which approximates the cross sectional area of a circular 100 um diameter via. All of the layers are non-magnetic, so $\mu_{ri}=1$ for i=1, 2, 4, and 5.

Figure 6:
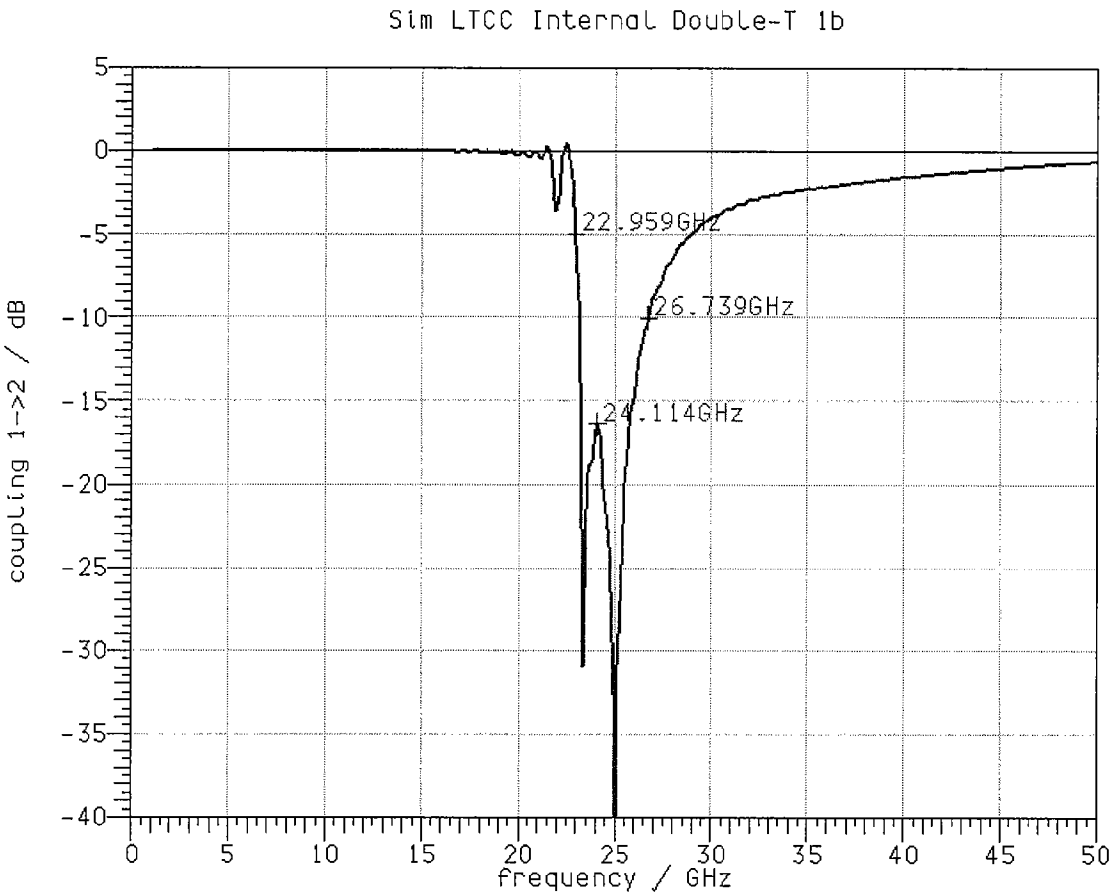
FIG. 6 shows the full-wave transmission response S21 for the finite length EBG structure of FIG. 5.

The transmission response from the Microstripes simulation of FIG. 5 is shown in FIG. 6. This transmission plot shows a fundamental stopband beginning near 23 GHz and extending at least beyond 27 GHz. In this example, the design parameters were selected to place the stopband to include the 24 GHz US ISM (Industrial, Scientific, Medical) band of 24.0 GHz to 24.250 GHz.

The rodded media of dielectric layers 401 and 405 may be modeled, for example, with formulas given by Clavijo, Diaz, and McKinzie in "Design Methodology for Sievenpiper High-Impedance Surfaces: An Artificial Magnetic Conductor for Positive Gain Electrically-Small Antennas," IEEE Trans. Microwave Theory and Techniques, Vol. 51, No. 10, October 2003, pp. 2678-2690, which is incorporated herein by reference. The permeability tensors for magneto-dielectric layers 201 and 205 may be written as:

$$\overline{\mu}_1=\overline{\mu}_5=\begin{bmatrix}\mu_{x1} & 0 & 0\\ 0 & \mu_{y1} & 0\\ 0 & 0 & \mu_{z1}\end{bmatrix}=\begin{bmatrix}\mu_{r1}\frac{(1-\alpha)}{(1+\alpha)} & 0 & 0\\ 0 & \mu_{r1}\frac{(1-\alpha)}{(1+\alpha)} & 0\\ 0 & 0 & \mu_{r1}(1-\alpha)\end{bmatrix}, \tag{24}$$

where the parameter $\alpha$ is the ratio of via cross sectional area to the unit cell area A:
and $$\alpha=\frac{\pi r^2}{A}=\frac{\pi r^2}{P^2} \tag{25}$$

The parameter $\alpha$ is typically much less than unity making the main diagonal elements in (24) slightly diamagnetic for the case of a non-magnetic host dielectric: $\mu_{r1}=\mu_{r5}=1$.

Figure 7:
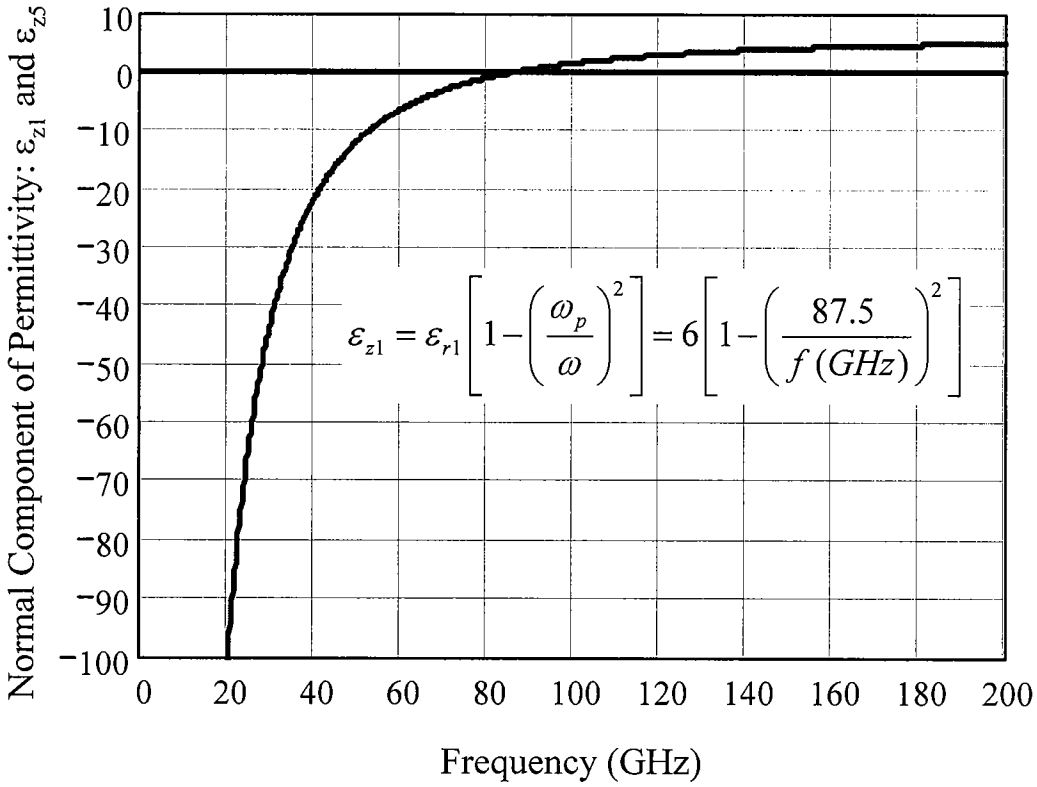
FIG. 7 shows the normal direction permittivity function for magneto-dielectric layers 201 and 205 in the effective medium model of FIG. 4.

The permittivity tensor for magneto-dielectric layers 201 and 205 may be written as $$\overline{\varepsilon}_1=\overline{\varepsilon}_5=\begin{bmatrix}\varepsilon_{x1} & 0 & 0\\ 0 & \varepsilon_{y1} & 0\\ 0 & 0 & \varepsilon_{z1}\end{bmatrix}=\begin{bmatrix}\varepsilon_{r1}\frac{(1+\alpha)}{(1-\alpha)} & 0 & 0\\ 0 & \varepsilon_{r1}\frac{(1+\alpha)}{(1-\alpha)} & 0\\ 0 & 0 & \varepsilon_{r1}\left[1-\left(\frac{\omega_p}{\omega}\right)^2\right]\end{bmatrix}, \tag{26}$$

where the plasma frequency of the rodded media may be expressed as $$\omega_p^2=\frac{1}{\frac{\mu_{r1}\varepsilon_{r1}A}{4\pi c^2}\left(\ln\left(\frac{1}{\alpha}\right)+\alpha-1\right)}, \tag{27}$$

and c is the speed of light in a vacuum. Using the design parameters for the Microstipes model of FIGS. 5 and 6, $\alpha=0.031$ which is much less than unity, the plasma frequency $\omega_p$ is 87.5 GHz. A plot of the normal (z-axis) component of permittivity for the rodded media is shown in FIG. 7. The normal permittivities $\in_{z1}$ and $\in_{z5}$ are negative over the frequency range associated with the fundamental stopband: about 23 GHz to about 30 GHz.

The permittivity and permeability tensors for the magneto-dielectric layers 202 and 204 are given above in equations (4) and (5). To calculate the effective capacitance Ci one may use the parallel-plate capacitor formula to obtain a lower bound:

$$C_i=\frac{\varepsilon_o\varepsilon_{ri}\left(\frac{s_i-g}{2}\right)}{t_i}\ \text{for}\ i=2\ \text{and}\ 4. \tag{28}$$

Here, for simplicity, the square patches on opposite sides of dielectric layer 402 are assumed to be the same size ($s_1=s_2$), and the same assumption holds for dielectric layer 404 ($s_3=s_4$).

Figure 8:
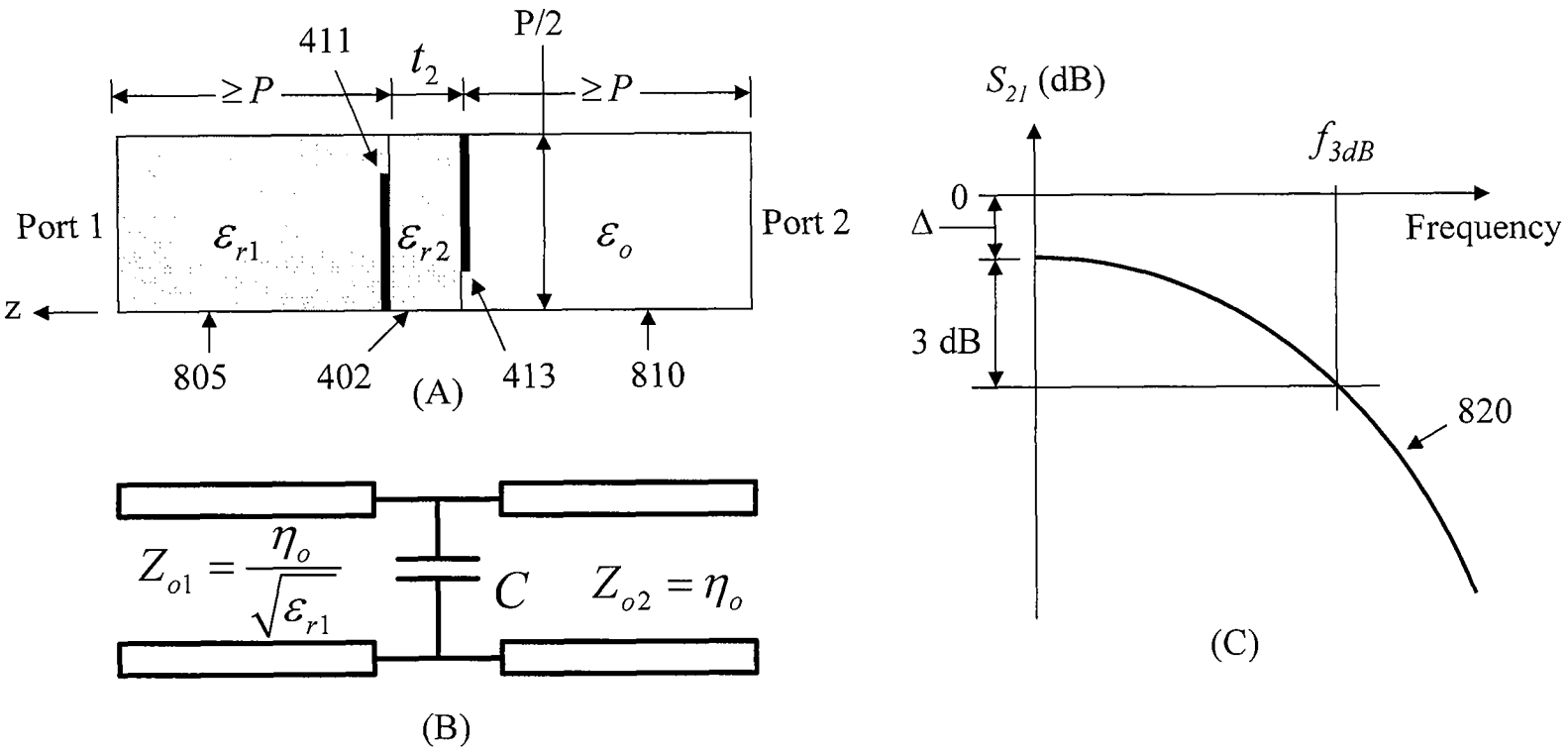
FIG. 8 illustrates a method for calculation of the effective capacitance for a periodic array of isolated conducting obstacles embedded in a host dielectric media: (a) waveguide model for a full-wave simulation; (b) equivalent transmission line model; and, (c) the resulting transmission response in dB vs. frequency.

The parallel-plate formula may be suitable for cases where the dielectric layer thickness $t_i$ is much less than the gap g between patches. However, when the dielectric layer thickness of layers 402 and 404 are comparable to the gap dimensions, the fringe capacitance between edges may become significant. For the geometry of FIG. 4, and more the complex geometries of subsequent examples, the effective capacitance C may be calculated from $S_{21}$ transmission curves using the procedure shown in FIG. 8. A full-wave electromagnetic simulator is used to model one quarter of a unit cell area of layer 402 as a shunt obstacle in a TEM (transverse electromagnetic) mode waveguide. This is shown in FIG. 8(*a*) where a dielectric-filled TEM mode waveguide (WG) 805 containing a relative dielectric constant of $\in_{r1}$, and an air-filler TEM mode WG 810 are on opposite sides of the dielectric layer 402. Conductive patches 411 and 413 may also be modeled as a physical component to determine the actual capacitance. The ports on each end are placed at least one period away from dielectric layer 402 to allow sufficient distance for higher order non-TEM modes to decay. In this example, the WG cross section is square since the unit cell has a square footprint and the two planes of symmetry inside each unit cell allow reduction of the solid model to only one fourth of the area of the unit cell. FIG. 8(*b*) shows the equivalent transmission line model for the TEM modes. The desired capacitance is a shunt load placed at the junction between two transmission lines of potentially dissimilar characteristic impedance where $\eta_0$ is the wave impedance of free space: 377Ω. The full wave simulation of FIG. 8(*a*) may have a transmission response 820 shown generically in FIG. 8(*c*). Curve 820 gives the low frequency limit of the transmission loss, Δ, as well as the frequency $f_{3dB}$ at which transmission has fallen by 3 dB from its low frequency limit. As a check on the simulation results, $$\Delta = 20\log\left(\frac{\sqrt[4]{\varepsilon_{r1}} + \frac{1}{\sqrt[4]{\varepsilon_{r1}}}}{2}\right)\text{ dB}. \tag{29}$$

Finally, the desired shunt capacitance may be calculated from $$C = \frac{1+\sqrt{\varepsilon_{r1}}}{2\pi f_{3\,dB}\eta_o}. \tag{30}$$

For the example shown in FIGS. 5 and 6, Δ=0.844 dB and C=0.109 pF per square. The assumption that a shunt capacitance models the magneto-dielectric layers 202 and 204 is valid when these layers are electrically thin at the frequency of interest, meaning $$\frac{\omega}{c}\sqrt{\varepsilon_{ri}}\,t_i << 1$$

for i=2 and 4. The procedure described in FIG. 8 may be used to calculate the effective capacitance of any arbitrarily-shaped obstacle or arbitrary inclusion. The periodic array of these arbitrarily-shaped obstacles may be modeled as magneto-dielectric layers 202 or 204.

Using the calculated effective capacitance of 0.109 pF/sq. for both layers 402 and 404 in the example yields the transverse permittivity of $\in_{xi}=\in_{yi}=C_i/(\in_0 t_i)=494$ for magneto-dielectric layers 202 and 204. In the example of FIG. 4, $\in_{avg}=\in_{ri}=10$, which allows the normal permeability to be calculated as $$\mu_{zi} = 2\frac{\varepsilon_{avg}}{\varepsilon_{trans,i}} = 2\frac{10}{494} = .0405$$

for magneto-dielectric layers 202 and 204. This completes the mapping of the physical example of FIG. 4 into the effective media model of FIG. 2.

Figure 9:
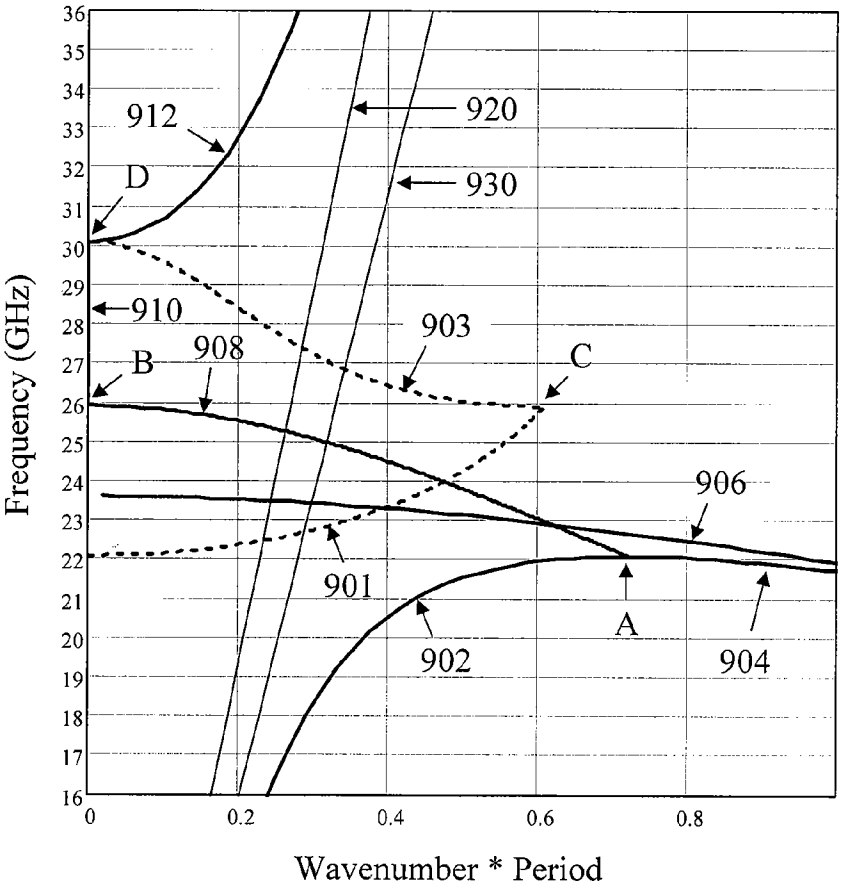
FIG. 9 is a TM mode dispersion diagram based on the effective medium model for the example of FIG. 4.

Application of the TRM to FIG. 2 allows evaluation the TM mode propagation constant, $k_x$. Equation (6) may be solved numerically for real and complex roots $k_x$ as a function of frequency. The numerical root finding was performed with Mathcad 14 licensed from Parametric Technology Corporation, but other general purpose software such as Matlab and Mathematica may be used for this purpose. The real and imaginary components of $k_x$ are plotted in the dispersion diagram of FIG. 9. The parameters for FIG. 9 are those assumed ($\in_{r1}=\in_{r5}=6$, $\in_{r2}=\in_{r4}=10$, $t_1=t_5=300$ um, $t_2=t_4=25$ um, $t_3=1000$ um) and calculated for the above example ($\omega_p$=87.5 GHz, α=0.031, $\in_{x2}=\in_{x4}=494$, $\mu_{y1}=\mu_{y5}=0.940$, and $\mu_{y2}=\mu_{y4}==1$). The abscissa is the product of wavenumber $k_x$ and the period P. This normalizes the abscissa to the range of zero to π for the irreducible Brillouin zone, since the Brillouin zone boundary is π/P.

In FIG. 9, the real part of the propagation constant $k_x$ is shown as a solid dark line. The imaginary part of $k_x$ is the attenuation constant, and is displayed as a dashed dark line. The line 920 is the free-space light line based on the speed of light in a vacuum. The line 930 is the light line based on the effective dielectric constant of the inhomogeneous PPW if all of the interior conductors were removed:

$$\varepsilon_{eff} = \frac{t_1+t_2+t_3+t_4+t_5}{\frac{t_1}{\varepsilon_{r1}}+\frac{t_2}{\varepsilon_{r2}}+\frac{t_3}{1}+\frac{t_4}{\varepsilon_{r4}}+\frac{t_5}{\varepsilon_{r5}}} \cong 1.49. \tag{31}$$

At low frequencies, below about 20 GHz, only one TM mode exists, labeled as 902, and it is asymptotic to the light line 930. Forward propagating modes are characterized by $k_x$ curves of positive slope. Conversely, backward propagating modes are characterized by $k_x$ curves of negative slope. Slow waves (phase velocity relative to the speed of light c) are plotted below the light line 920 while fast waves are plotted above line 920. The group velocity of a given mode is proportional to the slope of its dispersion curve, varying over the range of zero to c. Hence, the dominant mode is a slow forward wave that cuts off near 22 GHz where its group velocity (and slope) goes to zero at point A. There is a backward TM mode (curve 904) that is possible between about 15 GHz and 22 GHz. There is another distinct backward TM mode (curve 906) that is asymptotic to curve 904 at high wavenumbers, and it is cut off above approximately 23.6 GHz. There exists a forward fast wave (curve 912) whose low frequency cutoff is near 30 GHz. This fast TM mode is asymptotic to the light line 920 at high frequency.

Between 22 GHz and 30 GHz, the effective medium model predicts the existence of a backward wave complex mode and a purely evanescent mode. The complex mode has a real part 908 that extends from point A to point B. It has a corresponding imaginary part 901. This represents a backward propagating TM mode that attenuates as it travels. The evanescent TM mode exists from about 26 GHz to about 30 GHz and the real part is zero, bounded between endpoints B and D. The imaginary part of this evanescent mode is non-zero and has endpoints C and D. The effective medium model predicts an apparent stopband from near 22 GHz to near 30 GHz. It is an apparent stopband because the complex mode (908, 901) does exist in this frequency band, but the mode is attenuating as it travels. Furthermore, the backward TM mode 906 is also possible above 22 GHz, but its group velocity (and slope) is so low that it will be difficult to excite by coupling from another mode. The only other mode possible to couple with it over this frequency range is the complex mode that already has a significant attenuation constant. The frequency most likely for coupling between these two modes is that frequency where curves 906 and 908 intersect, which in this example is near 23 GHz.

A comparison of the full-wave transmission response in FIG. 6 for the finite EBG structure to the dispersion diagram of FIG. 9 shows substantial agreement. The transmission response shows an apparent stopband beginning near 23 GHz as compared to 22 GHz in the effective medium model. The transmission response shows a peak at about 24 GHz, which may be due to a backward wave mode. Note the intersection of backward wave modes shown as curves 906 and 908 in the effective medium model occurs near 23 GHz. The difference between these two frequencies within each model is consistent at about 1 GHz. Furthermore, the frequency of greatest stopband attenuation is near 25 GHz in the transmission response and near 26 GHz in the effective medium model. This is a frequency difference between models of about 1 GHz or 4%.

As another comparison, the peak attenuation predicted by the effective medium model is $\mathrm{Im}\{k_x\}P=0.61$ which yields an attenuation of near 5.3 dB per unit cell. As there are 5 complete unit cells (between centers of vias) in the finite structure, the peak attenuation should be on the order of 26.5 dB plus mismatch loss. FIG. 6 shows the peak attenuation to be on the order of 40 dB which is reasonable given the anticipated impedance mismatch between the port impedance of the full-wave model and the Bloch mode impedance of the EBG structure. The only feature that is not in clear agreement in both the effective medium model and the full-wave simulation is the upper band edge. The effective medium model predicts a distinct band edge to the stopband near 30 GHz while the transmission response for the finite EBG structure shows a soft transition near this frequency.

The effective medium model thus provides some physical insight into the nature of the possible TM modes, and may be computationally much faster to run compared to a full-wave simulation.

The structures and methods described herein may also be used as a slow-wave structure to control the phase velocity and the group velocity of the dominant PPW mode. Consider curve 902 in FIG. 9. The value of $\omega/k_x$ on any curve in the dispersion diagram is the phase velocity for that mode propagating in the x direction. For any point on curve 902, this value is less than the speed of light, and speed may be controlled by adjusting the slope of curve 930 (using the effective dielectric constant) and by adjusting the cutoff frequency (point A). The slow wave factor, $k_x/k_0$, for the dominant TM mode (quasi-TEM mode, or curve 902) is greater than unity for any of the inhomogeneous PPW examples described herein. Applications may also include delay lines and antenna beamformers, such as Rotman lenses or Luneberg lenses.

Example B

An EBG Structure after FIG. 2 with Single Layer Patches

Figure 10:
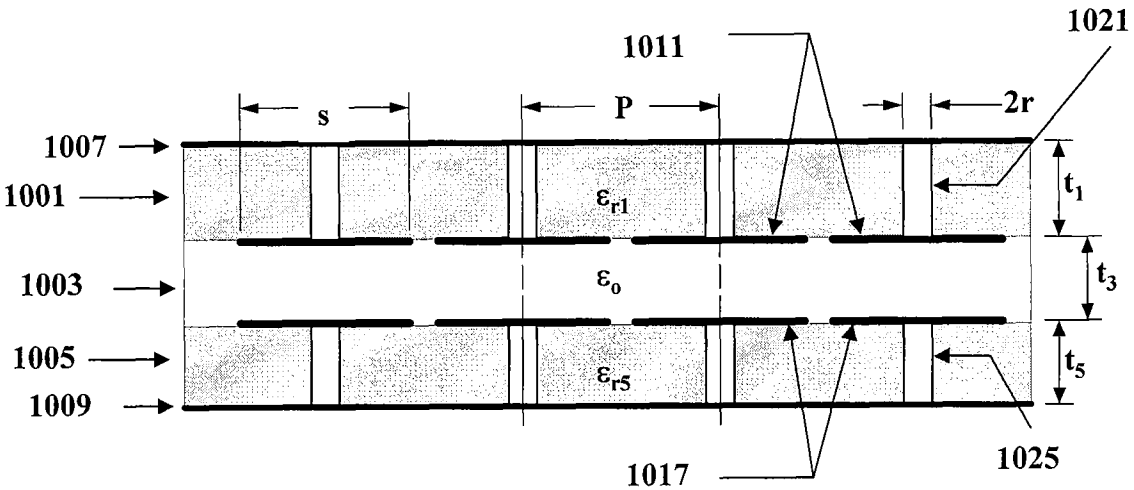
FIG. 10 shows an example after FIG. 2 as an EBG structure with single layer patches.

Another example is shown in FIG. 10. It is similar to the example of FIG. 4, but it has fewer dielectric layers and patches. However, this example may also be modeled using the effective medium layers shown in FIG. 2.

This example of FIG. 10 is an inhomogeneous PPW containing upper and lower conducting planes 1007 and 1009 respectively. The periodic structure contained within has a square lattice of period P; there is an air gap 1003 between dielectric layers 1001 and 1005; thicknesses of the three dielectric layers 1001, 1003, and 1005 are denoted as $t_1$, $t_3$, and $t_5$, respectively, and the relative dielectric constants of these layers are denoted as $\in_{r1}$ 1, and $\in_{r5}$ respectively.

This example contains a rodded medium in dielectric layers 1001 and 1005 which is a periodic array of conductive vias 1021 that extend from the upper conducting plane 1007 to a single layer of upper conductive patches 1011 located at the interface between layers 1001 and 1003, and an array of conductive vias 1025 that connect the lower conducting plane 1009 to a single layer of lower conductive patches 1017 located at the interface between layers 1003 and 1005. These two rodded mediums in host dielectric layers 1001 and 1005 may have a negative z-axis permittivity in the fundamental stopband, as previously described.

The upper conducting vias 1021 connect to a coplanar array of conducting patches 1011. The patches may be, for example, square and form a closely spaced periodic array designed to achieve an effective capacitance given as:

$$C_2 = \varepsilon_o \varepsilon_{avg} \frac{2P}{\pi} \ln\left(\frac{2P}{\pi g}\right), \tag{32}$$

where $\in_{avg}=(1+\in_{r1})/2$ and $g=P-s$ is the gap between patches. The thickness t2 for the effective medium layer 202 may be selected to be arbitrarily small, and the transverse permittivity for this layer may be expressed as:

$$\varepsilon_{x2} = \varepsilon_{y2} = \frac{C_2}{\varepsilon_0 t_2} = \varepsilon_{avg} \frac{2P}{\pi t_2} \ln\left(\frac{2P}{\pi g}\right). \tag{33}$$

The effective capacitance $C_2$ will be lower for the single layer of patches used in FIG. 10 when compared to the two layers of overlapping patches shown in FIG. 4. For the same parameters used in the above example, where P=500 um, s=390 um, $\in_{r1}=6$, then $C_2$ is 0.01048 pF/sq. The z-axis permittivity $\in_{z2}$ for layer 202 may be set to unity.

Evaluation of the effective capacitance $C_4$ and the transverse permittivity $\in_{x4}=\in_{y4}$ of the effective media layer 204 may, for the lower array of patches 1017, be accomplished by using equations (32) and (33) with only a change of subscripts. The upper rodded media need not have the same period, thickness, via diameter, patch size, shape or host dielectric constant as the lower rodded media. That is, each may be designed independently.

The upper and lower conductive patches 1011 and 1017 may be positioned as shown in FIG. 10 to be opposing one another. In this orientation, there will be some parallel-plate capacitance between opposing patches. However, herein, it is predominantly the fringe capacitance between adjacent coplanar patches that is enhanced. The objective is to provide a relative transverse permittivity for effective media model layers 202 and 204 that is much greater than unity.

Figure 11:
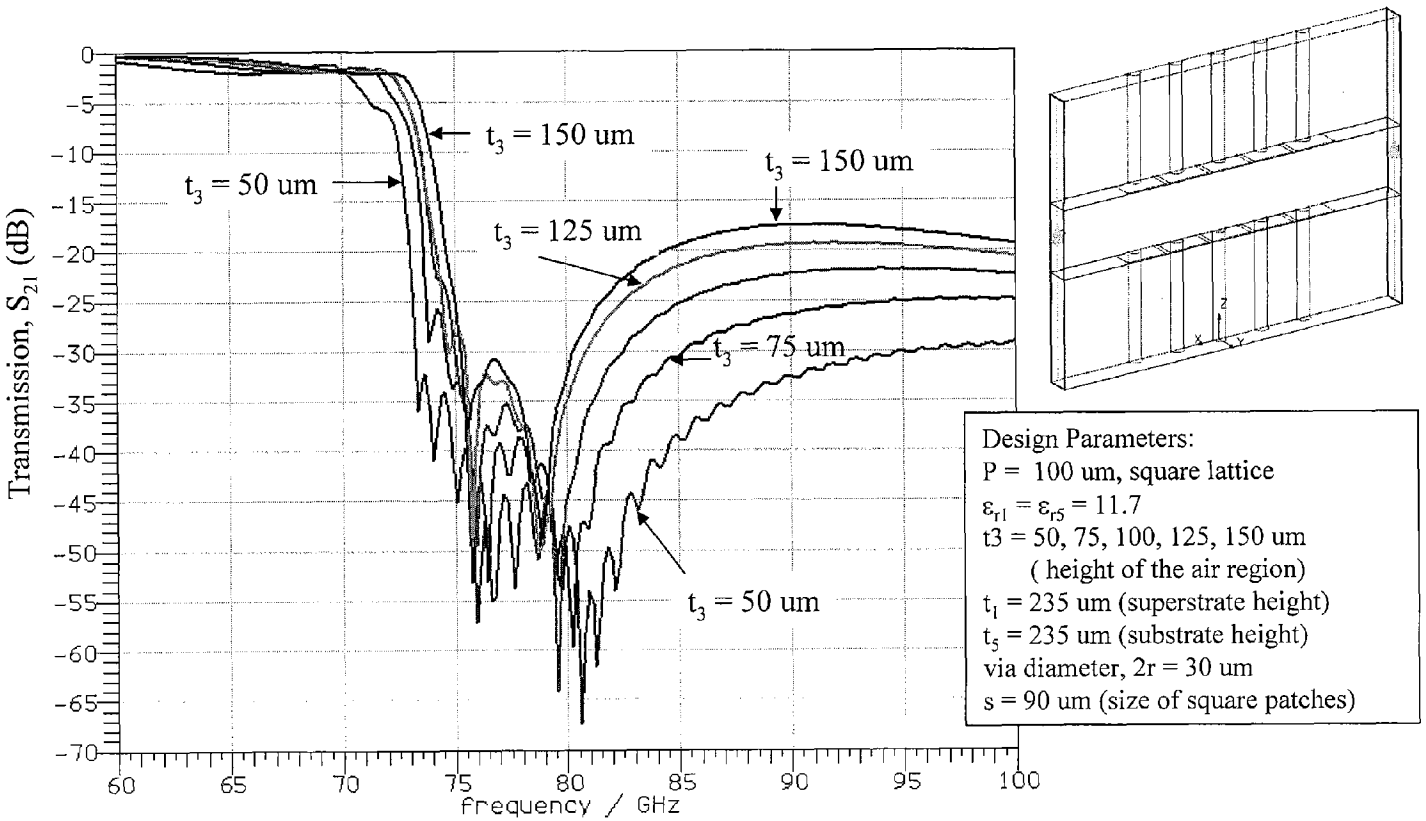
FIG. 11 shows the full-wave transmission response S21 for the finite EBG structure of FIG. 10.

The example shown in FIG. 10, may be fabricated, for example, with high resistivity semiconductor wafers such $\in_{r1}=\in_{r5}=11.7$, P=100 um, upper and lower via diameter 2r=30 um, upper and lower patches have size s=90 um, and $t_1=t_5=235$ um. The transmission response $S_{21}$ through five unit cells is shown in FIG. 11 where the height of the air gap 1003 is varied parametrically from 50 um to 150 um in 25 um increments. This is a MMW EBG structure designed to present a stopband at 77 GHz. The Microstripes solid model is also shown in FIG. 11 where the dielectric layers are omitted for clarity. Note that only ½ of a unit cell in the transverse direction is simulated since magnetic walls are the boundary condition for the sides of the WG. Magnetic walls may be considered to exist at the planes of symmetry which intersect the center of vias and the center of gaps. The ports are vertically polarized TE waveguides with zero frequency cutoff due to the magnetic sidewalls. The parametric results of FIG. 11 show that as the height of the air gap $t_3$ grows, the depth and bandwidth of the fundamental stopband will decrease. Conversely, as the gap $t_3$ decreases, the depth and bandwidth of the fundamental stopband will increase.

Example C

An EBG Structure after FIG. 2 with Non-Uniform Vias

Figure 12:
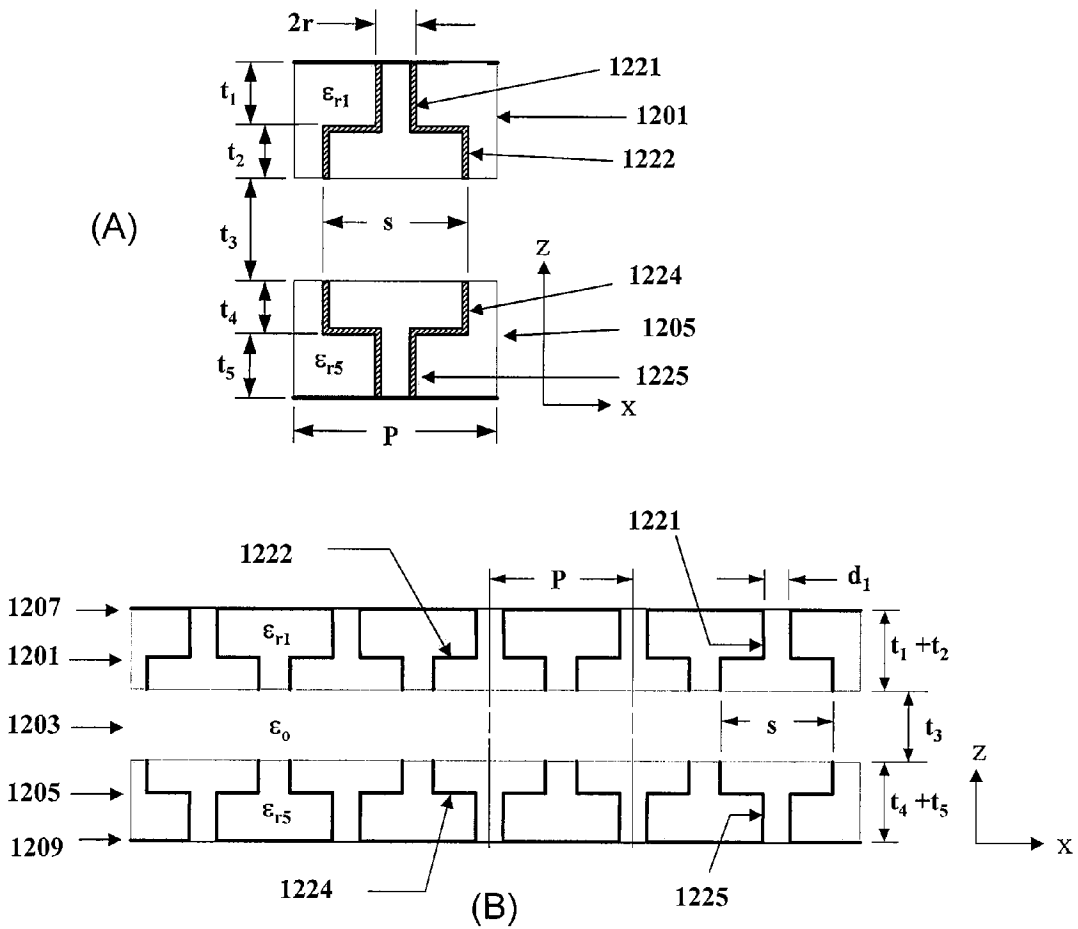
FIG. 12 shows an example after FIG. 2 as an EBG structure with non-uniform vias.

Another EBG structure is shown in FIG. 12. The structure is an inhomogeneous WG containing an array of vias where the vias have a non-uniform cross-sectional shape characterized by a high-aspect-ratio section which transitions into a low-aspect-ratio section. Herein, aspect ratio is defined as the ratio of via length to the largest cross sectional dimension, which is the diameter for a common cylindrical via. Each non-uniform via may be one contiguous conductor. The high aspect ratio section is used to realize a rodded media, and the low aspect ratio section is used to enhance the capacitive coupling between vias, or equivalently, to enhance the transverse permittivity for equivalent magneto-dielectric layers 202 and 204 in the effective medium model.

FIG. 12(*b*) is an inhomogeneous WG formed by upper and lower conducting planes 1207 and 1209. The periodic structure contained within has a square lattice of period P. In this example, there is an air gap 1203 between dielectric layers 1201 and 1205. Thicknesses of the three dielectric layers 1201, 1203, and 1205 are denoted as $t_1+t_2$, $t_3$, $t_4+t_5$, respectively, and the relative dielectric constants of these layers are denoted as $\in_{r1}$, and $\in_{r5}$ respectively.

FIG. 12(*a*) illustrates a detail of the unit cell in which a higher aspect ratio via 1221 of length $t_1$ connects the upper conductor 1207 to a lower aspect ratio via 1222. Via 1221 may have a circular cylindrical shape with a diameter of 2r. The lower aspect ratio via 1222 may have a length of $t_2$ and may have an essentially square footprint whose exterior side length is s. Therefore, the separation distance between adjacent lower aspect ratio vias in an array environment of FIG. 12(*b*) may be only P−s. The higher and lower aspect ratio vias 1221 and 1222 have a combined length $t_1+t_2$ which spans the thickness of the upper dielectric layer 1201. Similarly, the lower non-uniform vias may be comprised of a higher aspect ratio via 1225 of length $t_5$ that connects the lower conductor 1209 to a lower aspect ratio via 1224. Via 1225 may also have a circular cylindrical shape with a diameter of 2r. The lower aspect ratio via 1224 has a length of $t_4$ and may have an essentially square footprint whose exterior side length is also s. It is not necessary for the upper and lower non-uniform vias to be mirror images of each other as they appear in FIG. 12 since, in general, the vias may have different diameters, different side lengths, and even different cross-sectional shapes. Furthermore, the periods of the upper and lower vias may be different.

The array of higher aspect ratio vias 1221 forms a rodded medium in the upper dielectric layer 1201 which may be mapped into the magneto-dielectric layer 201 in the effective medium model. Similarly, the array of higher-aspect-ratio vias 1225 form a rodded medium in the lower dielectric layer 1205 which may be mapped into magneto-dielectric layer 205 in the effective medium model. These two rodded mediums in host dielectric layers 1201 and 1205 may have a negative z-axis permittivity in the fundamental stopband as described above. The permeability tensor and permittivity tensor for each rodded media may be calculated using equations (24) through (27).

The array of lower aspect ratio vias 1222 forms an effective capacitance $C_2$ in the upper dielectric layer 1201 which may be mapped into magneto-dielectric layer 202 in the effective medium model. Similarly, the array of lower aspect ratio vias 1224 forms an effective capacitance $C_4$ in the lower dielectric layer 1205 which may be mapped into magneto-dielectric layer 204 in the effective medium model. The permeability tensor and permittivity tensor for layers 202 and 204 may be calculated using equations (4) and (5). The value of $\in_{avg}$ in (5) is the host permittivity of the background dielectric, namely $\in_{r1}$ or $\in_{r5}$. To estimate the effective capacitance $C_i$ one may use the parallel-plate capacitor formula to obtain a lower bound:

$$C_i \cong \frac{\varepsilon_o \varepsilon_{r1} s t_i}{P-s} \text{ for } i = 2 \text{ and } 4. \tag{34}$$

A more accurate estimate of $C_i$ may be obtained using the procedure described in FIG. 8 and equation (30). All of the conductive portions of the lower aspect ratio via should be included in this simulation to find $f_{3dB}$.

The non-uniform vias may be fabricated in a semiconductor wafer by using reactive ion etching (RIE). This process is capable of fabricating substantially vertical sidewalls for 3D structures. Two different masks may be used to fabricate the high aspect ratio holes and the low aspect ratio holes in separate steps. Then the entire via structure may be plated with metal. Shown in FIG. 12 are substantially vertical sidewalls for the low aspect ratio vias. The side walls may be tapered during fabrication by simultaneously using RIE and chemical etching processes. Using both RIE and chemical etching may speed up the processing steps.

Figure 13:
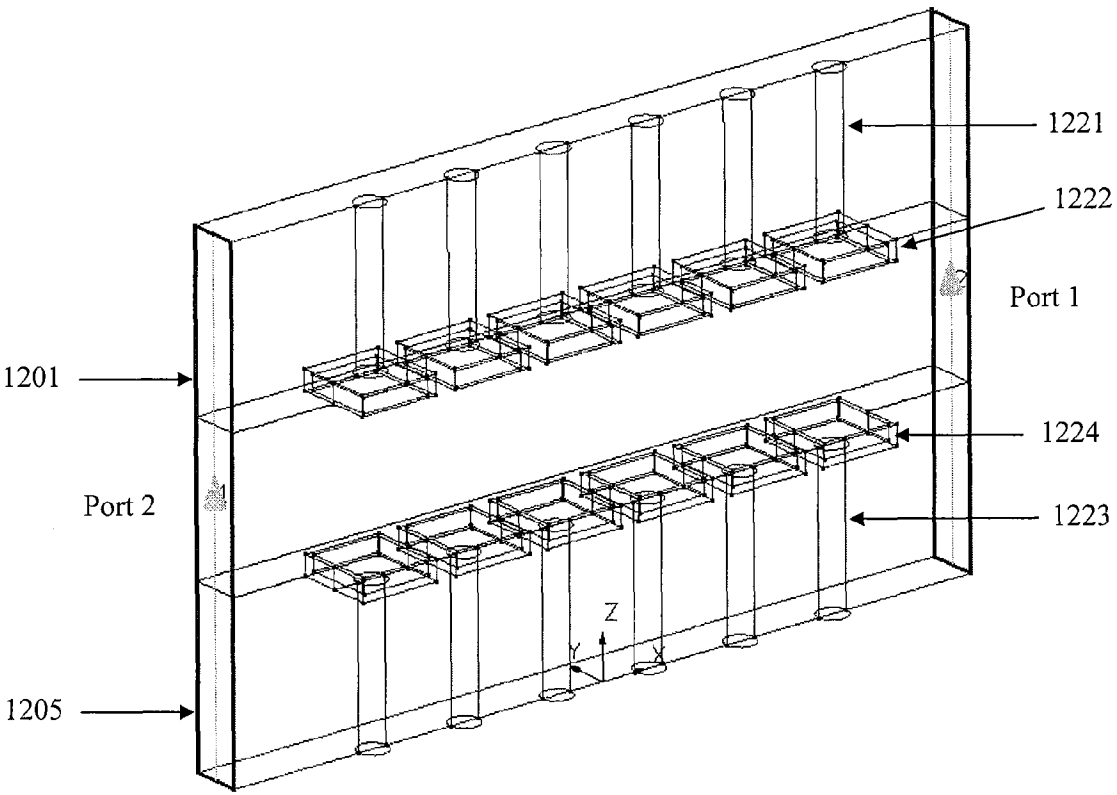
FIG. 13 shows a 3D wire frame model used in a full-wave electromagnetic simulation of the EBG structure of FIG. 12.
Figure 14:
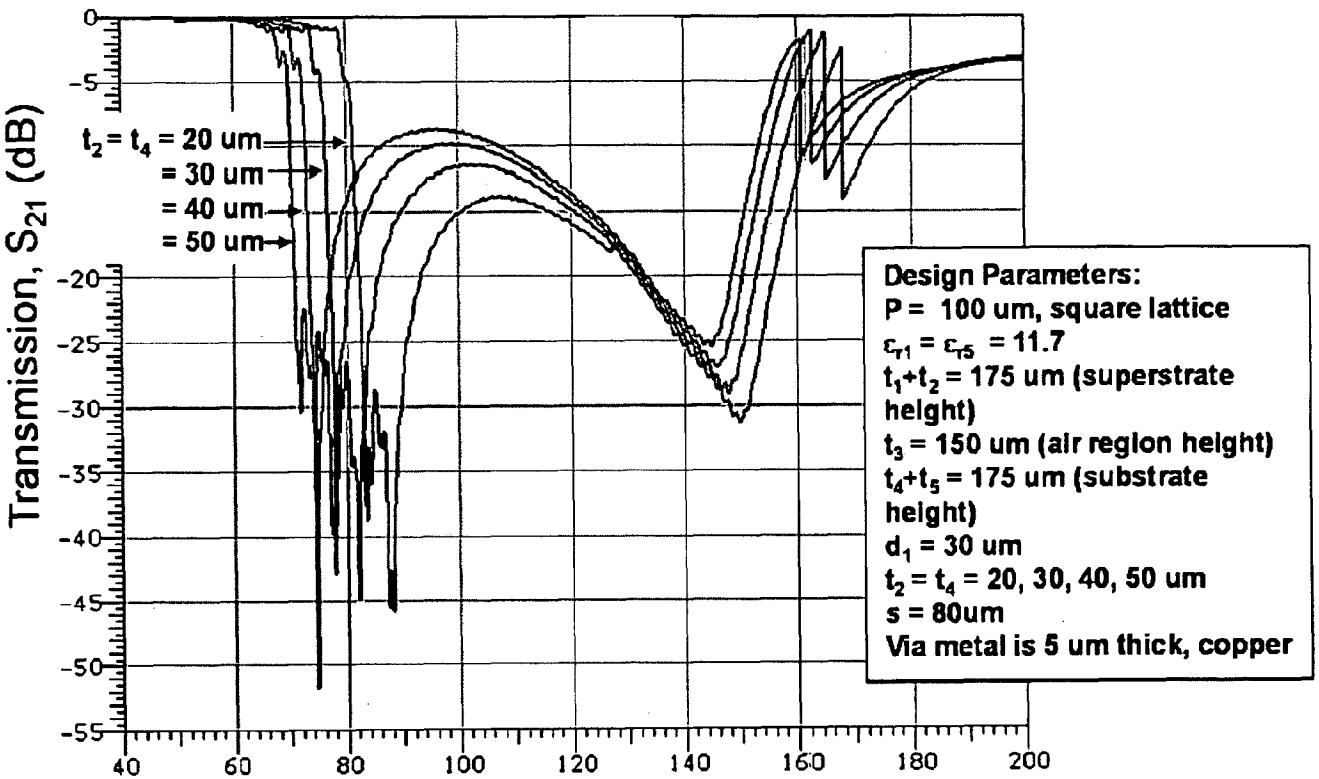
FIG. 14 shows a full-wave simulation of transmitted power through the finite length model of the EBG structure shown in FIG. 13.

In an example, the structure shown in FIG. 12 may be fabricated using silicon wafers such that $\in_{r1}=\in_{r5}=11.7$ and P=100 um. Higher aspect vias are circular in cross section with diameters 2r=30 um, and lower aspect vias are square in cross section with size s=80 um. Dielectric layers have a thickness $t_1+t_2=t_4+t_5=175$ um. The air gap $t_3=150$ um. The transmission response $S_{21}$ through six unit cells is shown in FIG. 14 where the height of the lower aspect ratio vias 1122 and 1224 are varied parametrically from 20 um to 50 um. This millimeterwave (MMW) EBG structure is designed to yield a stopband centered near about 80 GHz. The Microstripes solid model used for simulation is shown in FIG. 13. Again only ½ of a unit cell in the transverse direction is simulated since magnetic walls are the boundary condition for the sides of the waveguide. The parametric results of FIG. 14 show that, as the length of the lower aspect ratio vias increases, so does the effective capacitance $C_2$ and $C_4$, which lowers the frequency of the fundamental stopband.

The example of FIG. 12 has lower aspect ratio vias comprised of solid conducting walls. However, the sidewalls may be comprised of a linear array of smaller diameter vias. This may be suitable for manufacturing if LTCC or organic laminate technology is used. The lower-aspect-ratio via may resemble a bird cage with a solid conducting floor and walls of vertical, smaller diameter vias. The LTCC example may or may not have a conductive ceiling in this example.

The example of FIG. 12 is illustrated with hollow vias. In practice, the non-uniform vias may be partially or completely filled with dielectric materials without significantly altering performance. The interior of the vias may be filled with a conductive material, which may result in a slight shift (lowering) of the frequency response since the effective capacitance may increase by a relatively small percentage.

The EBG structure of FIG. 12 may be considered as two separate dielectric slabs 1201 and 1205, each slab having an array of conductive vias 1221, 1222, 1224, and 1225. If the upper dielectric slab 1201, which may correspond to a cover in a package, is removed, the remaining lower dielectric slab 1205 and the associated conductive surfaces 1209, 1224, and 1225 may be considered as an open EBG structure. This open EBG structure may guide surface waves at frequencies below the fundamental TM mode cutoff, and may exhibit a surface wave bandgap where the TM and the TE modes are evanescent in the lateral (x and y) directions. The surface wave bandgap for such an open EBG structure may be calculated with the same TRM as described above where the transmission line 303 becomes an infinitely long matched transmission line.

Example D

An EBG Structure after FIG. 2 with 3D Patches Having Sidewalls

Figure 15:
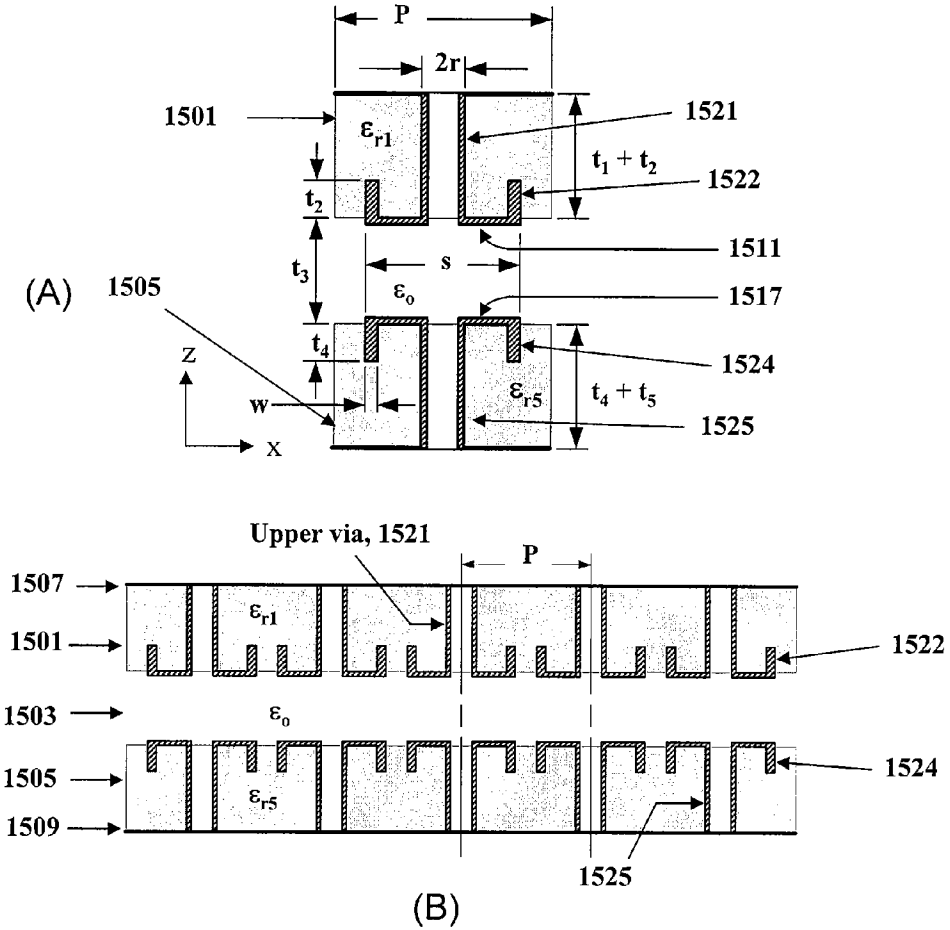
FIG. 15 shows an example after FIG. 2 as an EBG structure with 3D patches having vertical sidewalls.

The EBG structure of FIG. 10 may be modified to enhance the effective capacitance between coplanar single layer patches. An example is shown in FIG. 15 as an inhomogeneous WG, where the conductive patches have essentially vertically oriented conductive sidewalls 1522 and 1524. The relative close proximity of sidewalls between adjacent unit cells may result in a parallel plate capacitance which is greater than the edge capacitance of the same size coplanar patches. Furthermore, the sidewalls 1522 and 1524 may be buried in the upper or lower dielectric layers 1501 and 1505, which may also enhance the capacitive coupling due to the relatively high dielectric constant of these dielectric layers compared to the air gap 1503.

The example of FIG. 15(*b*) is an inhomogeneous WG formed by upper and lower conducting planes 1507 and 1509. The periodic structure contained within has a square lattice of period P. In this example there is an air gap 1503 between dielectric layers 1501 and 1505. The thicknesses of the three dielectric layers 1501, 1503, and 1505 are denoted as $t_1+t_2$, $t_3$, $t_4+t_5$, respectively, and the relative dielectric constants of these layers are denoted as $\in_{r1}$, 1, and $\in_{r5}$, respectively.

FIG. 15(*a*) illustrates a detail of the unit cell in which an upper conductive via 1521 of length $t_1+t_2$ connects the upper conductor 1507 to an upper patch 1511. Via 1521 may have a circular cylindrical shape with a diameter of 2r. The upper patch 1511 is connected to a conductive upper sidewall 1522 that attaches to perimeter of the patch 1511. In this example, the upper patch 1511 is square with side length s and the upper sidewall has a vertical height of $t_2$ buried in the upper dielectric layer 1501. The upper sidewall 1522 is uniform in height around the perimeter of the patch 1511, and the width of the upper and lower sidewalls 1522 and 1524 is denoted as w.

Similarly, in the unit cell of FIG. 15(*a*), a lower conductive via 1525 of length $t_4+t_5$ connects the lower conductor 1509 to a lower patch 1517. Via 1525 may have a circular cylindrical shape with a diameter of 2r. The lower patch 1517 is connected to a conductive lower sidewall 1524 that attaches to perimeter of the patch 1517. In this example the lower patch 1517 is square with side length s and the lower sidewall has a vertical height of $t_4$ in which it is buried in the lower dielectric layer 1505.

The patches 1511 and 1517 are square in the example of FIG. 15, but that is not a limitation. Any polygonal patch shape may be used, including an inter-digital shape. To enhance the effective capacitance, conductive fingers of an inter-digital patch may extend into the upper (or lower) dielectric layer 1501 (or 1505) to have a vertical dimension $t_2$ (or $t_4$) similar to the sidewalls.

The upper and lower patches, sidewalls, and vias need not be mirror images of each other as they are shown in FIG. 15 since, in general, they may have, for example, different diameters, different side lengths, and different cross-sectional shapes.

The upper vias 1521 form a rodded medium in the upper dielectric layer 1501 which may be mapped into magneto-dielectric layer 201 in the effective medium model. Similarly, the array of lower vias 1525 form a rodded medium in the lower dielectric layer 1505 which may be mapped into magneto-dielectric layer 205 in the effective medium model. These two rodded mediums in host dielectric layers 1501 and 1505 may have a negative z-axis permittivity in the fundamental stopband as previously described. The permeability tensor and permittivity tensor for each rodded media may be calculated using equations (24) through (27).

The array of upper patches 1511 and sidewalls 1522 result in an effective capacitance $C_2$ in the upper dielectric layer 1501 which may be mapped into magneto-dielectric layer 202 in the effective medium model. Similarly, the array of lower patches 1517 and sidewalls 1524 result in an effective capacitance $C_4$ in the lower dielectric layer 1505 which may be mapped into magneto-dielectric layer 204 in the effective medium model. The permeability tensor and permittivity tensor for layers 202 and 204 may be calculated using equations (4) and (5). The value of $\in_{avg}$ in (5) is the host permittivity of the background dielectric, namely $\in_{r1}$ or $\in_{r5}$. To estimate the effective capacitance $C_i$ one may use the parallel-plate capacitor formula (28) to obtain a lower bound. A more accurate estimate of $C_i$ may be found using the procedure described in FIG. 8 and equation (30). The conductive portions of the sidewalls and patches should be included in the simulation to calculate $f_{3dB}$.

The sidewalls 1522 and 1524 may be fabricated in a semiconductor wafer by using reactive ion etching (RIE) to cut trenches. Then the trenches may be plated with a metal to create conductive sidewalls. FIG. 15 shows essentially vertical sidewalls, but the sidewalls may be tapered in fabrication by simultaneously using RIE and a chemical etching processes. An advantage of using both RIE and chemical etching may be to speed up the processing steps.

Figure 16:
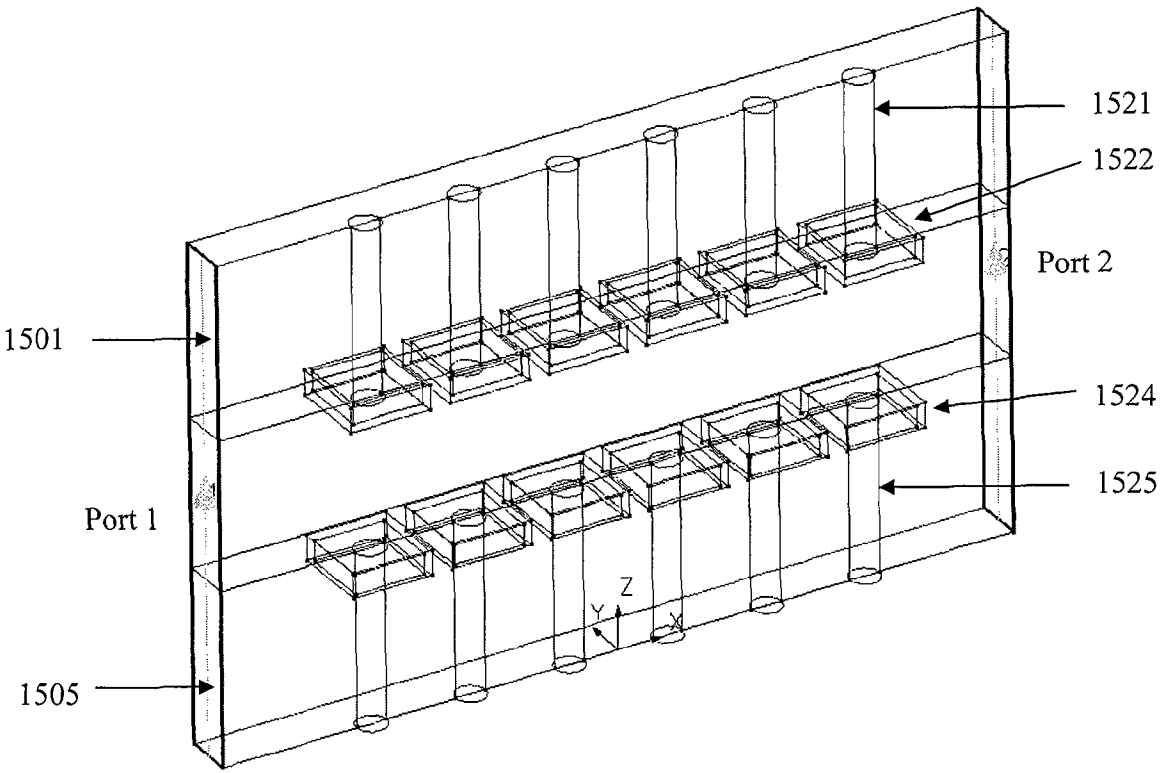
FIG. 16 shows a 3D wire frame model used in a full-wave electromagnetic simulation of the EBG structure of FIG. 15.
Figure 17:
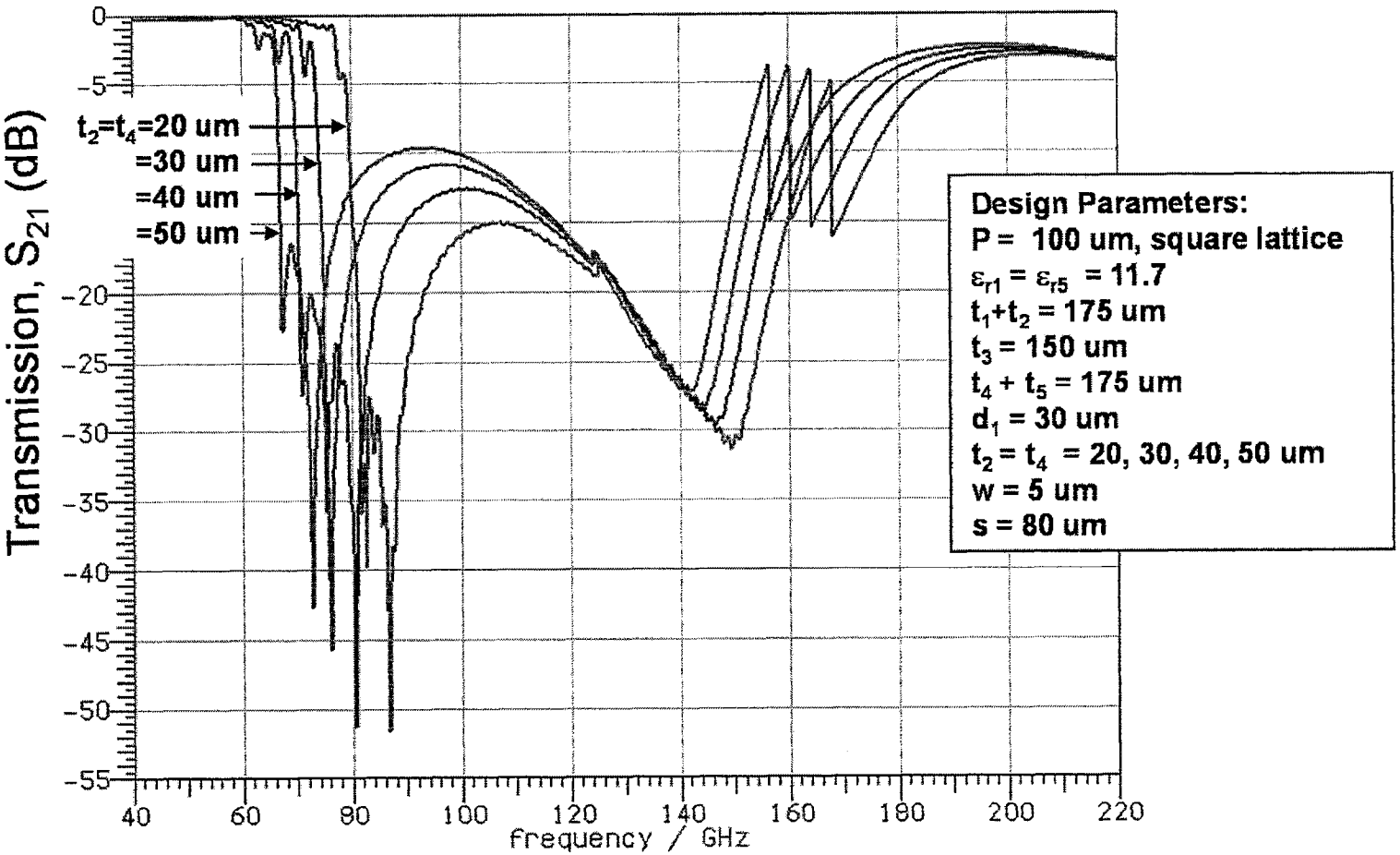
FIG. 17 shows a full-wave simulation of transmitted power through the finite length model of the EBG structure shown in FIG. 16.

The example shown in FIG. 15, may be fabricated with silicon semiconductor wafers such that $\in_{r1}=\in_{r5}=11.7$, P=100 um, all vias have diameters 2r=30 um, the patches are square with size s=80 um, and $t_1+t_2=t_4+t_5=175$ um. The air gap $t_3=150$ um. The calculated transmission response $S_{21}$ through six unit cells is shown in FIG. 17 where the heights $t_2$ and $t_4$ of the sidewalls 1522 and 1524 are varied parametrically from 20 um to 50 um. This MMW EBG structure exhibits a stopband near 80 GHz. The Microstripes solid model used for simulation is shown in FIG. 16. Again, only one half of a unit cell in the transverse direction is simulated since magnetic walls are the boundary condition for the sides of the WG. The parametric results of FIG. 17 show that, as the height of the sidewalls increase, so do the effective capacitances $C_2$ and $C_4$, which lowers the frequency of the fundamental stopband.

In the example shown in FIG. 15 the upper and lower sidewalls are solid conducting walls. However, the sidewalls may be, for example, a linear array of smaller diameter vias. This is may be a suitable manufacturing technique if the EBG structure is built using LTCC technology or organic laminates.

Example E

An EBG Structure after FIG. 2 with Pyramidal Vias

Figure 18:
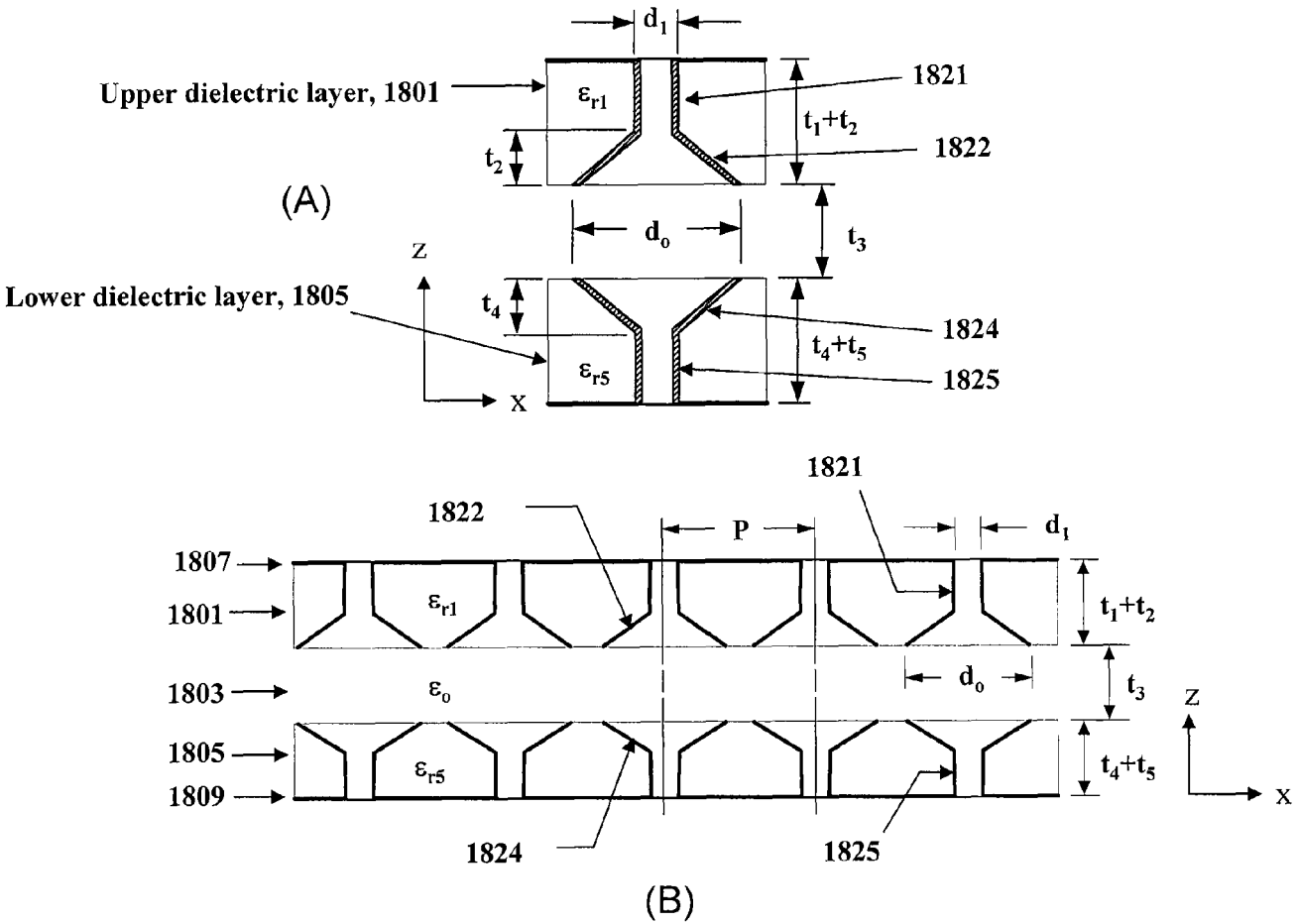
FIG. 18 shows an example after FIG. 2 as an EBG structure with pyramidal vias.

An EBG structure that uses an alternative shape of low aspect ratio conductive vias is shown in FIG. 18. This example is similar to the example of FIG. 12 except that the lower-aspect-ratio vias are square pyramids instead of square columns. All other features of the example of FIG. 18 are consistent with features of the example of FIG. 12.

If the example of FIG. 18 is fabricated using silicon wafers for dielectric layers 1801 and 1805, then anisotropic etching may be used to form the pyramidal vias 1822 and 1824. A unit cell is shown of FIG. 18(*a*). The base of the pyramids has a length $d_0$. The square pyramids 1822 and 1824 taper down in size to meet the higher-aspect-ratio vias 1821 and 1825, which are cylindrical vias of diameter $d_1$. The height of the square pyramids may be determined from the relationship $$d_0=d_1+2h\tan(\theta) \tag{35}$$

where $h=t_2=t_4$ and $\theta$ is the half angle of the pyramid. For anisotropically etched silicon, $\theta\cong 54°$. The high-aspect-ratio vias 1821 and 1825 may be formed, for example, using reactive ion etching (RIE). The entire non-uniform via may then be plated. In an aspect, the height of the pyramidal via may approach the entire thickness of the host dielectric layer: $t_1+t_2$ or $t_4+t_5$.

In another aspect, the example shown in FIG. 18, may be fabricated from high-resistivity silicon semiconductor wafers such that $\in_{r1}=\in_{r5}=11.7$, P=100 um, the higher aspect ratio vias have diameters $d_1$=30 um, the pyramids have a base size $d_0$=80 um, and $t_1+t_2=t_4+t_5$=150 um. The air gap $t_3$=150 um.

Figure 19:
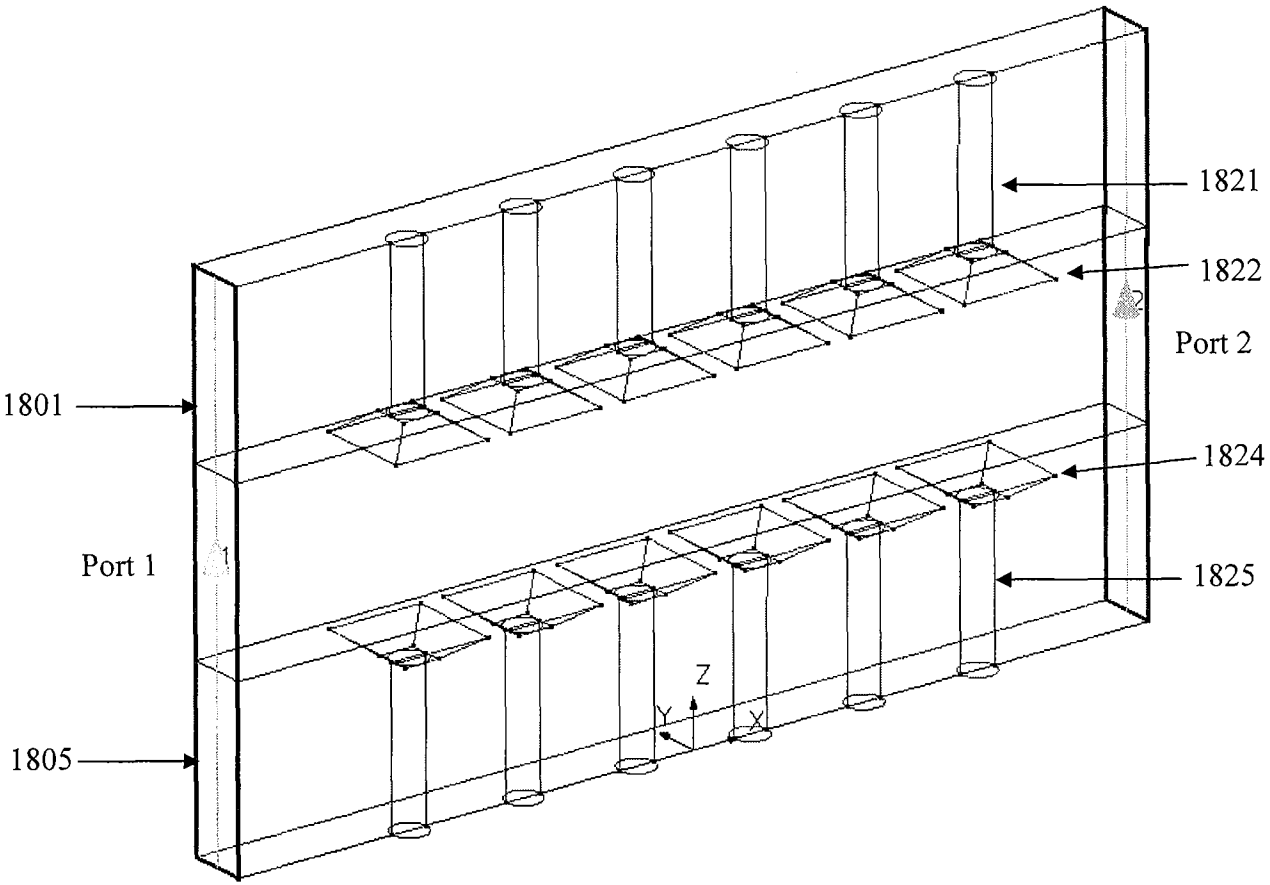
FIG. 19 shows a 3D wire solid model used in a full-wave electromagnetic simulation of the EBG structure of FIG. 18.
Figure 20:
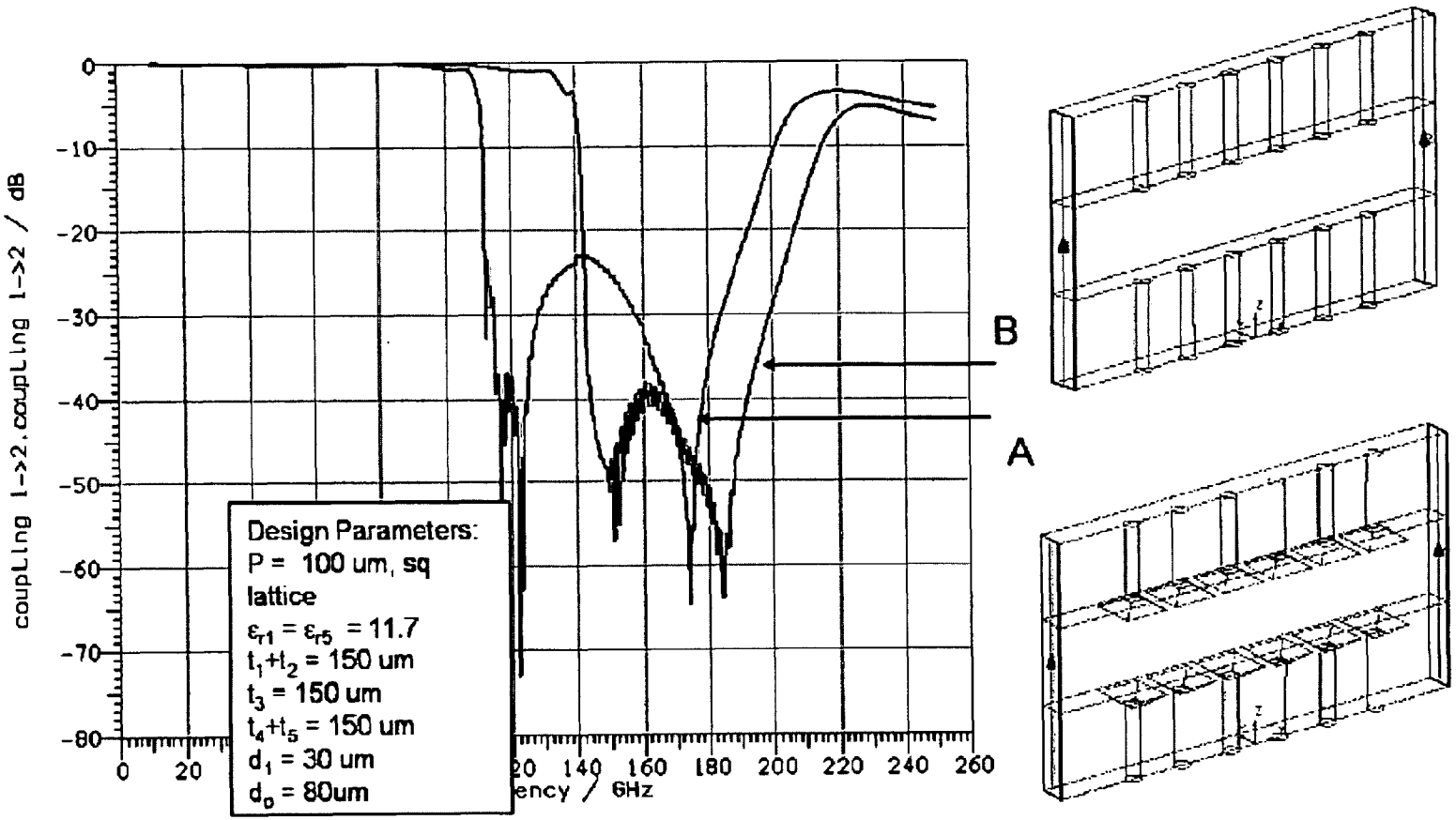
FIG. 20 shows a full-wave simulation of transmitted power through the finite length model of the EBG structure shown FIG. 18.

The transmission response $S_{21}$ through six unit cells of the EBG structure in FIG. 19 is shown in FIG. 20 where curve A is for the anisotropically etched vias. The TM mode stopband appears from about 110 GHz to near 200 GHz assuming a −10 dB coupling specification. Again, only one half of a unit cell in the transverse direction is simulated since magnetic walls are the boundary condition for the sides of the WG. Also shown in FIG. 20 is a transmission curve B for the case where each via is a simple cylinder of diameter 30 um. The stopband extends from near 140 GHz to near 216 GHz, again assuming a −10 dB coupling specification. The pyramidal shape for the ends of the non-uniform vias appears to enhance the effective capacitance between vias, resulting in a lower frequency stopband.

Four Layer Effective Media Model

Figure 21:
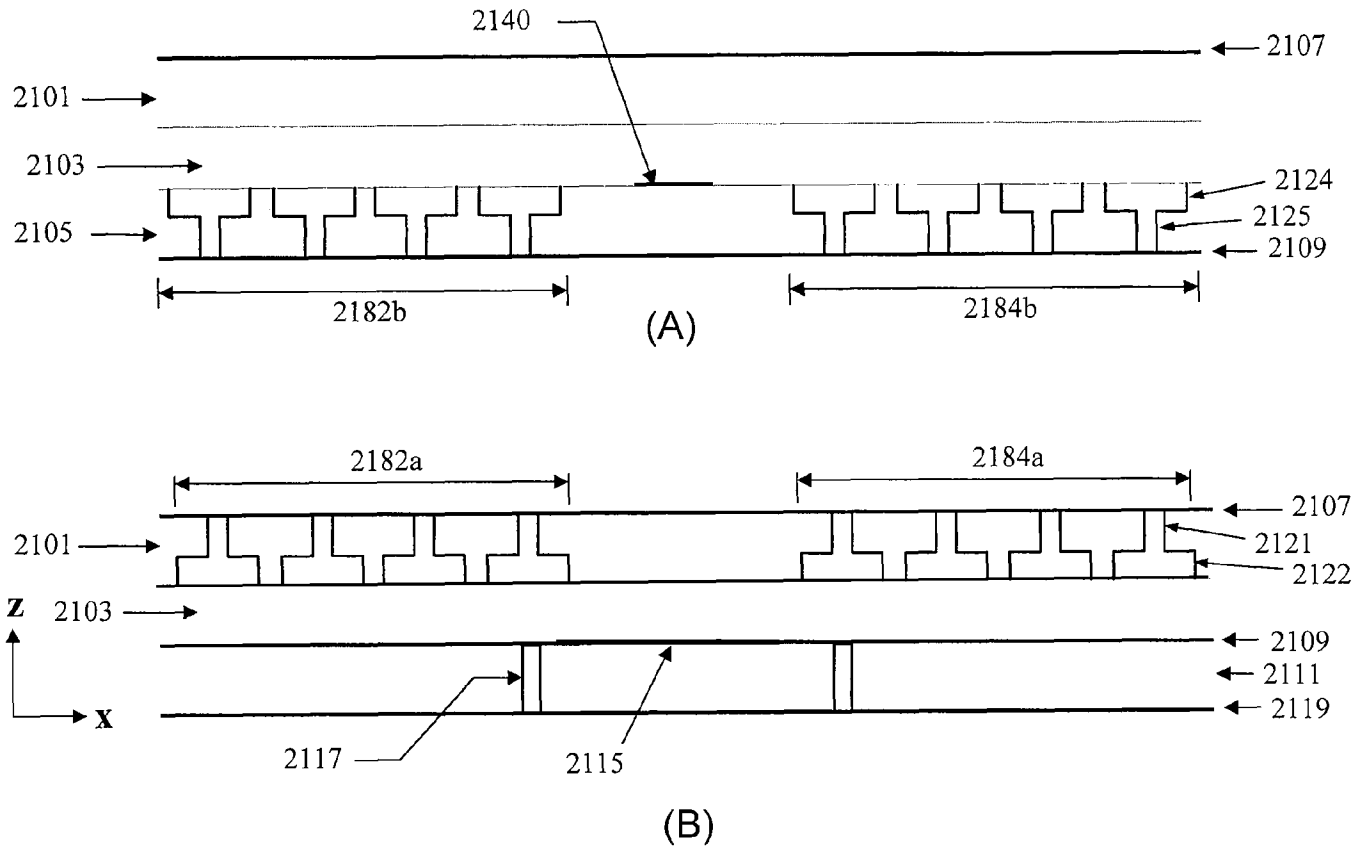
FIG. 21(*a*) shows one embodiment of the present invention using an EBG structure with non-uniform vias in proximity to a covered microstrip transmission line, (b) shows another embodiment of an EBG structure using non-uniform vias and fabricated into the shielded cover of a CPW transmission line.

The package cover in FIG. 1(*b*) may not contain part of an EBG structure such as 184*a*; for instance, the length of the vias in the cover may cause the package height to be too tall. FIG. 21(*a*) illustrates the cross section of a shielded package containing a covered microstrip transmission line 2140 that may be disposed below a dielectric layer 2103 (such as an air gap) and another dielectric layer 2101. The transmission line may be surrounded on both sides by EBG structures 2182*b* and 2184*b* which may be comprised of arrays of conductive vias of non-uniform cross sectional shapes that are fabricated in the lower dielectric layer 2105 and electrically connected to the lower conducting plane 2109. Each non-uniform via may be comprised of a low aspect ratio via 2124 connected to a high aspect ratio via 2125. The EBG structure may be used to suppress the propagation of parasitic modes in the inhomogeneous PPW that can cause crosstalk and package resonance. The inhomogeneous PPW of FIG. 21(*a*) may be modeled as a four-layer effective medium where the vias of the lower dielectric layer 2105 may be modeled using two magneto-dielectric layers, one characterized by high transverse permittivity whose thickness is the height of the lower aspect ratio vias 2124, and the second characterized by negative normal permittivity whose thickness is the height of the higher aspect ratio vias 2125. Such a four layer effective medium model is shown in FIG. 22 where the bottom two layers 2204, 2205 comprise the EBG structure responsible for mode suppression.

In other design situations there may be a local ground plane from a coplanar waveguide (CPW) that is part of the cover or substrate. An example is shown in FIG. 21(*b*) where a CPW transmission line is shielded by a cover layer 2101 that contains EBG structures 2182*a* and 2184*a*. The CPW ground plane is the lower conducting plane 2109 of an inhomogeneous PPW. The EBG structure may prevent the CPW from coupling RF power into the PPW that contains the air gap 2103, and which is bounded by conductive planes 2107 and 2109. Each EBG structure 2182*a* and 2184*a* may be comprised of a two-dimensional array of conductive vias of non-uniform cross sectional shape that may be connected to the upper conductive plane 2107. The inhomogenous PPW may be modeled as a three-layer effective medium model comprised of two magneto-dielectric layers, and one isotropic layer for the air gap. It may be considered to be the limiting case of a four-layer effective medium model, such as shown in FIG. 22, where the height of one of the isotropic dielectric layers, such as 2201, has gone to zero. The example of FIG. 21(*b*) may be termed a conductor-backed coplanar waveguide (CB-CPW) since conductive plane 2119 may act to shield the backside or lower side of the CPW transmission line. In this example, shorting vias 2117 are fabricated in the dielectric layer 2111 upon which the CPW center conductor 2115 is printed. The shorting vias 2117 connect the coplanar ground plane 2109 to the backside ground plane 2119 and may inhibit RF power from being coupled from the CPW into the PPW formed by conductive planes 2109 and 2111. In another aspect, the CPW may not be shielded on the bottom side, in which circumstance the conductive plane 2119 and shorting vias 2117 may be omitted.

Figure 22:
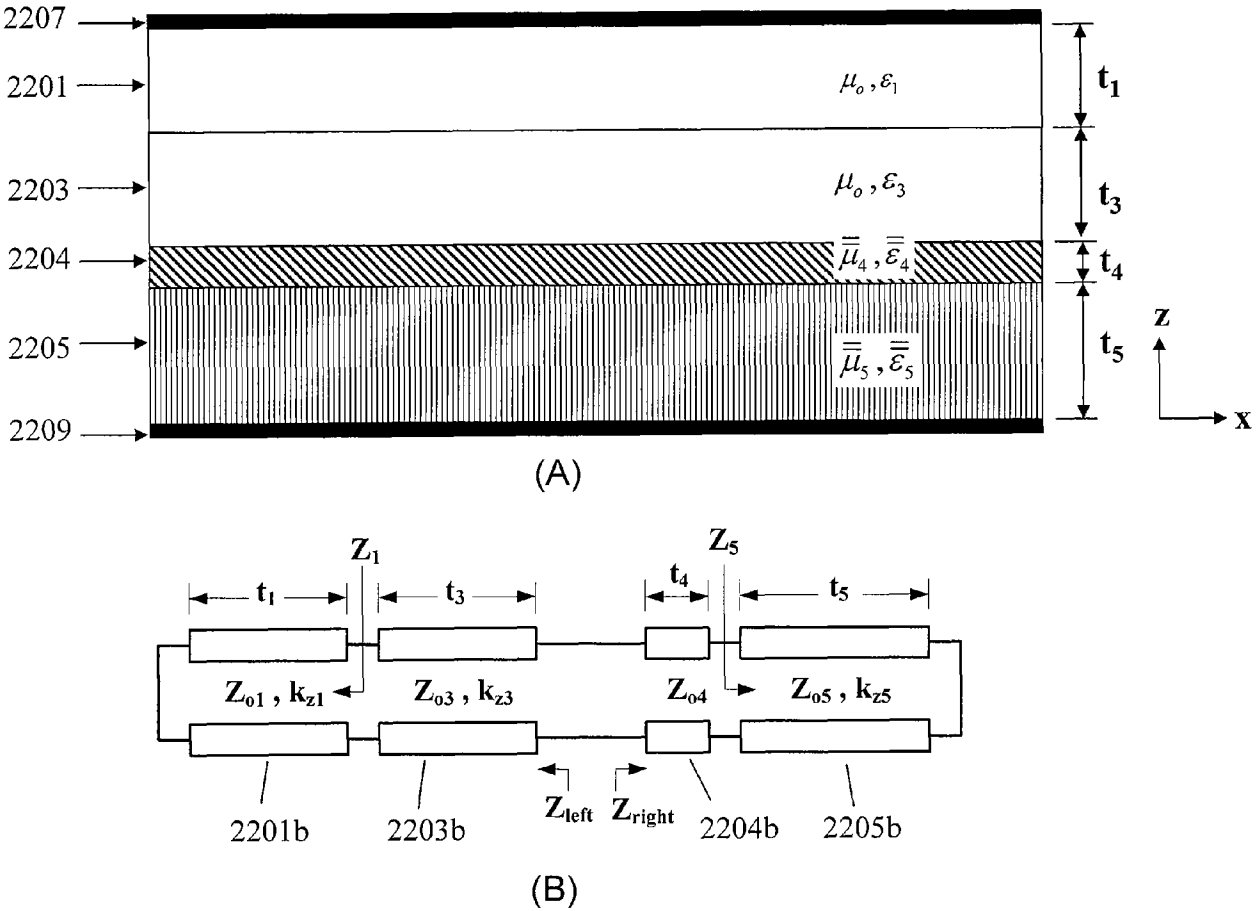
FIG. 22(*a*) shows an effective medium model for another example; and, (b) shows the corresponding equivalent transmission line model.

FIG. 22 shows a four-layer effective medium model. The inhomogeneous PPW contains anisotropic magneto-dielectric layers 2204, and 2205. These may be planar layers in which the permittivity tensor and permeability tensor may be described using equations (2) through (5). Layers 2201 and 2203 are isotropic dielectric layers of relative permittivity $\in_{r1}$ and $\in_{r3}$. In some examples, layer 2203 may be an air gap where $\in_{r3}=1$, or an isotropic dielectric having a higher relative permittivity. The layers may be contained between the upper conductor 2207 and the lower conductor 2209 such that electromagnetic fields are effectively confined between upper and lower conductors. Layers 2204 and 2205 may be considered a bi-uniaxial media where the tensor components of the main diagonals are equal in the transverse directions: the x and y directions.

An equivalent TL representation for the inhomogeneous PPW of FIG. 22(*a*) is shown in FIG. 22(*b*). This equivalent circuit is comprised of four cascaded TLs, one for each layer shown in FIG. 22(*a*). Short circuits are used on both ends (left and right) of the transmission lines to represent the upper and lower conductors 2207 and 2209 respectively. Equivalent transmission lines 2201*b*, 2203*b*, 2204*b*, and 2205*b* are used to model transverse electric field $E_x$ and the transverse magnetic field $H_y$ in layers 2201, 2203, 2204, and 2205, respectively.

The TM mode propagation constants may be calculated using the TRM described above by solving equation (6). However, the equations for impedances $Z_{left}$ and $Z_{right}$ in FIG. 22(*b*) are given as:

$$Z_{left}(\omega) = Z_{o3}\frac{Z_1\cos(k_{z3}t_3) + j\,z_{o3}\sin(k_{z3}t_3)}{Z_{o3}\cos(k_{z3}t_3) + jZ_1\sin(k_{z3}t_3)} \quad (36)$$

$$Z_1(\omega) = jZ_{o1}\tan(k_{z1}t_1) \quad (37)$$

$$Z_{right}(\omega) = Z_{o4}\frac{Z_5\cos(k_{z4}t_4) + j\,Z_{o4}\sin(k_{z4}t_4)}{Z_{o4}\cos(k_{z4}t_4) + jZ_5\sin(k_{z4}t_4)} \quad (37)$$

$$Z_5(\omega) = jZ_{o5}\tan(k_{z5}t_5) \quad (39)$$

For TM-to-x modes, the characteristic impedance $E_x/H_y$ may be written as $$Z_{oi} = \frac{k_{zi}}{\omega\varepsilon_o\varepsilon_{xi}}, \text{ for } i = 1, 3, 4 \text{ and } 5. \quad (40)$$

where $k_{zi}$ is the frequency dependent propagation constant in the normal or z direction:

$$k_{zi}(\omega, k_x) = \sqrt{\left(\frac{\omega}{c}\right)^2\varepsilon_{xi}\mu_{yi} - k_x^2\frac{\varepsilon_{xi}}{\varepsilon_{zi}}}, \text{ for } i = 4 \text{ and } 5. \quad (41)$$

For the isotropic dielectric layer 2201 and 2203, the z directed propagation constant reduces to $$k_{zi}(\omega, k_x) = \sqrt{\left(\frac{\omega}{c}\right)^2\varepsilon_{xi} - k_x^2}, \text{ for } i = 1 \text{ and } 3. \quad (42)$$

The TE mode propagation constants may also be calculated using the TRM by solving equation (18). However, the equations for admittances $Y_{left}=1/Z_{left}$ and $Y_{right}=1/Z_{right}$ in FIG. 22(*b*) are given as:

$$Y_{left}(\omega) = Y_{o3}\frac{Y_1\cos(k_{z3}t_3) + j\,Y_{o3}\sin(k_{z3}t_3)}{Y_{o3}\cos(k_{z3}t_3) + jY_1\sin(k_{z3}t_3)} \quad (43)$$

$$Y_1(\omega) = jY_{o1}\cot(k_{z1}t_1) \quad (44)$$

$$Y_{right}(\omega) = Y_{o4}\frac{Y_5\cos(k_{z4}t_4) + j\,Y_{o4}\sin(k_{z4}t_4)}{Y_{o4}\cos(k_{z4}t_4) + jY_5\sin(k_{z4}t_4)} \quad (45)$$

$$Y_5(\omega) = jY_{o5}\cot(k_{z5}t_5) \quad (46)$$

For TE-to-x modes, the admittance $H_x/E_y$ may be written as $$Y_{oi} = \frac{k_{zi}}{\omega\mu_o\mu_{xi}} \text{ for } i = 1, 3, 4 \text{ and } 5. \quad (47)$$

For TE waves, the z-directed propagation constants are:

$$k_{zi}(\omega, k_x) = \sqrt{\left(\frac{\omega}{c}\right)^2\varepsilon_{yi}\mu_{xi} - k_x^2\frac{\mu_{xi}}{\mu_{zi}}} \text{ for } i = 4 \text{ and } 5. \quad (48)$$

and

-continued $$k_{zi}(\omega, k_x) = \sqrt{\left(\frac{\omega}{c}\right)^2\varepsilon_{yi} - k_x^2} \text{ for } i = 1 \text{ and } 3. \quad (49)$$

The effective medium model of FIG. 22(*a*) will exhibit a stopband for TM modes when layers 2204 and 2205 have similar tensor properties as described above for layers 204 and 205 respectively in FIG. 2. Layer 2204 may have a relatively high transverse permittivity, much greater than unity. Layer 2205 may have a negative normal permittivity, such that a TM mode stopband may be formed in the inhomogenous PPW of FIG. 22(*a*).

Examples of structures whose electromagnetic properties map into the effective medium model of FIG. 22(*a*) are presented in FIGS. 23, 24, 25, and 26. They are each a version of examples introduced in FIGS. 4, 12, 15, and 18 respectively where the upper periodic array of conductors has been removed.

Figure 23:
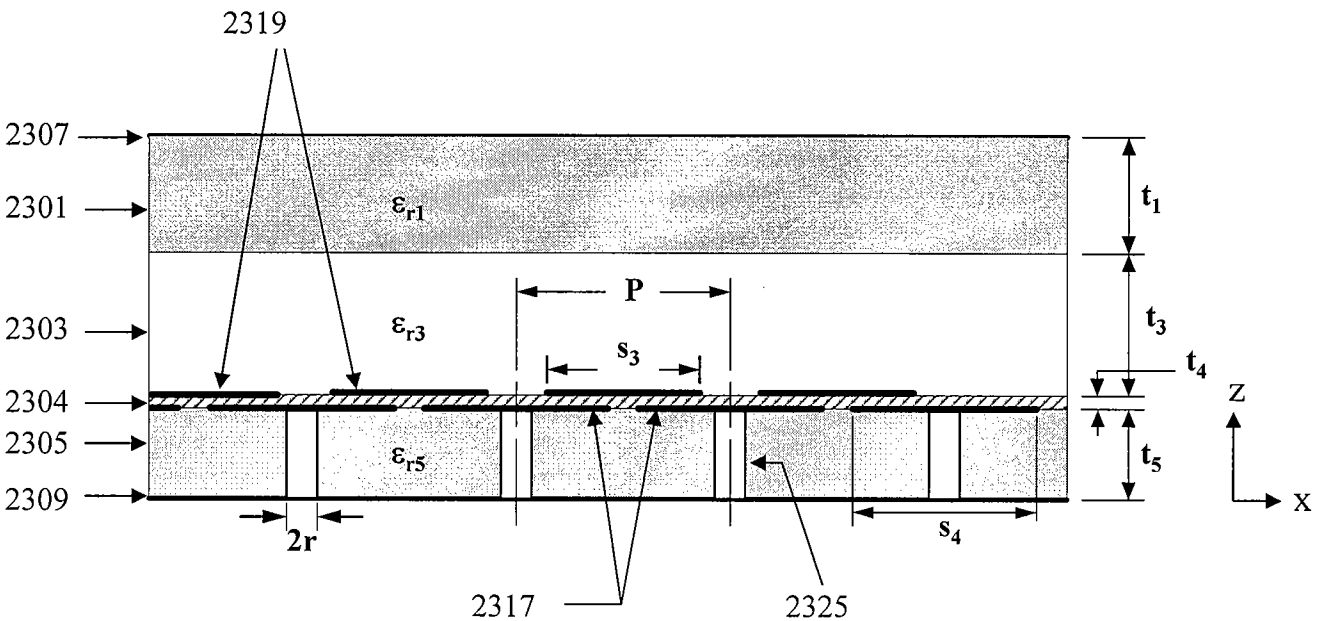
FIG. 23 shows an example of the present invention that may be modeled by the effective medium model of FIG. 22 and is an EBG structure with overlay patches.
Figure 24:
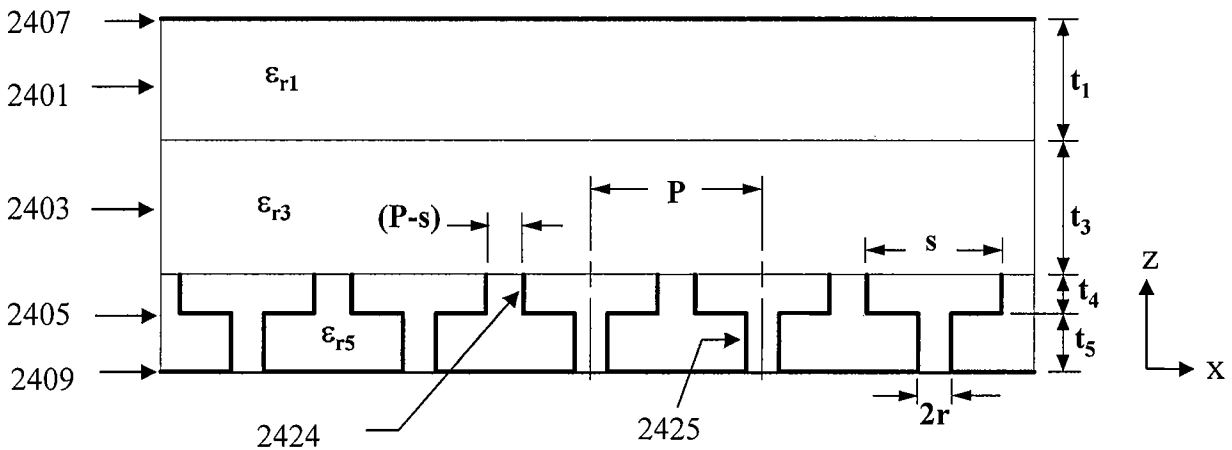
FIG. 24 shows an example of the present invention that may be modeled by the effective medium model of FIG. 22 and is an EBG structure with non-uniform vias.
Figure 25:
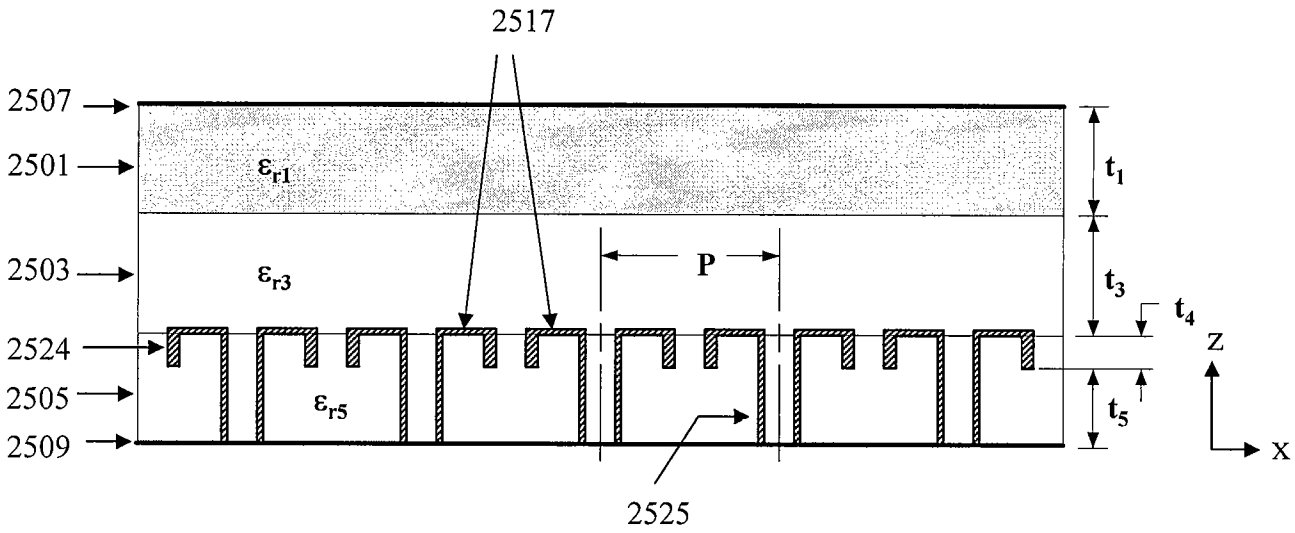
FIG. 25 shows an example that may be modeled by the effective medium model of FIG. 22 and is an EBG structure with 3D patches that have vertical sidewalls.
Figure 26:
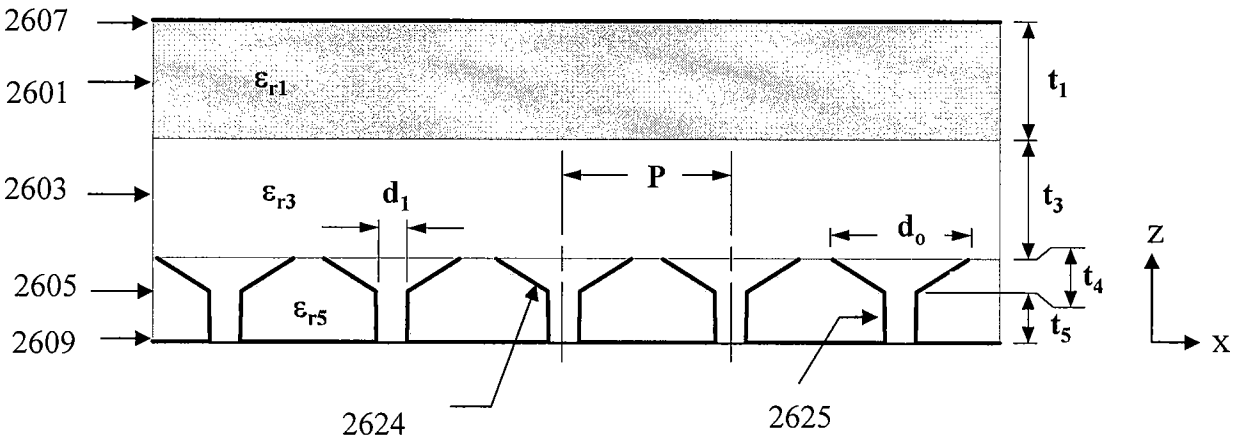
FIG. 26 shows an example that may be modeled by the effective medium model of FIG. 22 and is an EBG structure with pyramidal vias.

The 4 layer examples shown in FIGS. 23, through 26 may be simpler to manufacture than the 5 layer examples shown in FIGS. 4, 12, 15, and 18. However, in the 5 layer examples, the thickness $t_3$ of layer 3, which may be an air gap, can be approximately twice as large for the same bandwidth and depth of the fundamental TM mode stopband. This added height may be a usable in an MMIC package that contains a die with thick substrates, or stacked dies. Another consideration for the package designer is that for a fixed height of $t_3$, the 5 layer examples may have a wider fundamental TM mode stopband than the corresponding 4 layer examples.

In some examples, the dielectric layer 2201 of FIG. 22 may be omitted to create a three layer inhomogenous PPW. This may be considered the as a limiting case where thickness $t_1$ goes to zero. The analysis is the same as described above except that $Z_1$ reduces to zero, or a short circuit. Structurally the examples are the same as shown in FIGS. 23, 24, 25, and 26 except that the dielectric layers 2301, 2401, 2501, and 2601 are omitted.

The dielectric and conducting materials described in the above examples are representative of some typical applications in MMIC packages. Many other material choices are possible, and the selection of materials is not considered a limitation, as each material may be characterized and analyzed to provide design parameters. Dielectric layers may include semiconductors (Si, SiGe, GaAs, InP), ceramics (Al2O3, AlN, SiC, BeO) including low temperature co-fired ceramic (LTCC) materials, and plastic materials such as liquid crystal polymer. Metals may include (Al, Cu, Au, W, Mo), and metal alloys (FeNiCo (Kovar), FeNiAg (SILVAR), CuW, CuMo, Al/SiC) and many others. The substrate and cover (or upper and lower dielectric layers) need not be made of the same materials.

In an aspect, the different dielectric layers used in a given EBG structure can have different electrical or mechanical properties. The patch layers may contain patterns more elaborate than simple square patches, such as circular, polygonal, or inter-digital patches. Some of the patches of the capacitive layers may be left floating rather than being connected to conductive vias. Ratios of key dimensions may differ from illustrations presented.

Furthermore, the EBG structures of the examples may use additional layers to make a manufacturable product or for other purposes, some of which may be functional. For instance, thin adhesion layers of TiW may be used between a silicon wafer and deposited metal such as Au, Cu, or Al. Insulating buffer layers may be added for planarization. Passivation layers or conformal coatings may be added to protect metal layers from oxidizing. All of these additional manufacturing-process related layers are typically thin with respect to the thicknesses of $t_1$ through $t_5$, and their effect may be viewed as a perturbation to the stopband performance predicted by the above analytic methods.

In the preceding figures only a finite number of unit cells are illustrated: fewer than 20 per figure. However EBG structures may contain hundreds or even thousands of unit cells within a particular package. Yet, not all of the available area within the package may be utilized for EBG structures.

Furthermore, it should be understood that all of the unit cells need not be identical in a particular package. The EBG or stopband may be designed to have differing properties in various portions of the package so as to create, for example, a broader band for the mode suppression structure. There may also be EBG designs which are tuned to different stopband frequencies. A package design may be used where there are multiple frequency bands in an electrical circuit and, hence, may employ EBG structures tuned to different stopbands in different physical locations.

In the examples illustrated, the EBG structures are shown as located adjacent to RF transmission lines. However, the EBG structures may also be fabricated over the microstrip, CPW, or other transmission lines, such as in a cover, and the transmission lines may be fabricated into the opposing base.

Although only a few exemplary embodiments of this invention have been described in detail above, those skilled in the art will readily appreciate that many modifications are possible in the exemplary embodiments without materially departing from the novel teachings and advantages of the invention. Accordingly, all such modifications are intended to be included within the scope of this invention as defined in the following claims.

The invention claimed is:

1. An apparatus for controlling parallel-plate waveguide (PPW) modes, comprising:

a first and a second conductive surface sized and dimensioned to form a parallel plate waveguide (PPW);

a plurality of dielectric layers disposed in the PPW; and an array of conductive structures having a non-uniform cross sectional shape is formed in at least one of the plurality of dielectric layers, wherein the conductive structures have a non-uniform cross sectional shape comprised of a first via having a first cross sectional shape connected to a second via having a second uniform cross sectional shape; the first via has an aspect ratio of less than one and a first length; and, the second via has an aspect ratio of greater than one and a second length, the first and the second lengths dimensioned such that the length of the first via is at least 15 percent of a total length of the first and the second vias.

2. The apparatus of claim 1, wherein the array of conductive structures has a dimension of at least 3×3.

3. The apparatus of claim 1, wherein the array of conductive structures are electrically connected to one of the first or the second conductive surfaces.

4. The apparatus of claim 1, wherein the dielectric layer that contains the non-uniform vias is a semiconductor wafer.

5. The apparatus of claim 1, wherein a first dielectric layer and a second dielectric layer of the plurality of dielectric layers have a same relative permittivity value.

6. The apparatus of claim 1, wherein the first aspect-ratio sections of the array of conductive structures are in the shape of a rectangular brick or an inverted pyramid.

7. The apparatus of claim 1, wherein the array of conductive structures is periodic, and wherein the structure period, the structure height, the cross sectional shape, and the permittivity of at least one of the plurality of dielectric layers, are selected to provide an electromagnetic stopband over a frequency range.

8. The apparatus of claim 1, sized and dimensioned to form one of a microwave or a millimeterwave integrated circuit (MMIC) package.

9. An electromagnetic bandgap structure, comprising:

a conductive surface having a dielectric layer on a surface thereof; and an array of conductive structures formed in the dielectric layer;

wherein at least one of the conductive structures has at least a first cross sectional shape and a second cross sectional shape, and where the first and second cross sectional shapes have different aspect ratios: the first cross sectional shape is characterized by an aspect ratio less than one, and the second cross sectional shape is characterized by a higher aspect ratio, and a length of the first aspect ratio cross sectional shape is at least 15% of a total length of first cross sectional shape and the second cross sectional shape.

10. The electromagnetic bandgap structure of claim 9, wherein the cross-sectional area of the conductive structures varies within the dielectric layer such that the cross-sectional area is smaller at an end proximal to the conductive surface, and the cross-sectional area is larger at an end distal from the conductive surface.

11. The structure of claim 9, wherein the dielectric layer and the conductive structures of the array of conductive structures comprise a magneto-dielectric medium.

12. The structure of claim 11, wherein a relative permittivity of the dielectric layer is between 1 and about 12.

13. The structure of claim 12, wherein the relative permittivity of the dielectric layer is between about 2 and about 10.

14. The structure of claim 9, wherein the dimensionality of the array of conductive structures is at least 3×3.

15. The structure of claim 9, wherein conductive structures of the array of conductive structures are sized, shaped and spaced so that, in combination with the relative permittivity of the dielectric layer, an electronic band gap (EBG) is formed.

16. The structure of claim 9, wherein conductive structures of the array of conductive structures are vias formed within the dielectric layer.

17. An apparatus for controlling parallel-plate waveguide (PPW) modes, comprising:

a first conductive surface, and a second conductive surface, disposed parallel to the first conductive surface;

a first anisotropic magneto-dielectric layer comprising a first sub-layer and a second sub-layer, each sub-layer having a plurality of vias formed therein, wherein the first sub-layer has a ratio of via area to unit cell area which is greater than 0.25, and the second sub-layer has a ratio of via area to unit cell area which is less than 0.25; and an isotropic dielectric layer;

wherein the first anisotropic magneto-dielectric layer and the isotropic dielectric layer are disposed between the first conductive surface and the second conductive surface.

18. The structure of claim 17, wherein each of the sub-layers of the first magneto-dielectric layer is characterizable as having a layer tensor relative permittivity and a layer tensor relative permeability, each said layer tensor permittivity and layer tensor permeability having non-zero elements on the main diagonal with x and y tensor directions being in-plane of the layer and the z tensor direction being normal to the layer surface.

19. The structure of claim 18, wherein the second sub-layer is adjacent to one of the conductive surfaces and has an effective relative permittivity in the z tensor direction that is negative over a frequency band of suppression of electromagnetic waves.

20. The structure of claim 19, wherein the first sub-layer faces the isotropic layer and has relative permittivities in the x and y tensor directions which are positive and greater than unity over the frequency band of control.

21. The structure of claim 20, wherein the effective relative permittivity in the x or y tensor directions is between about 100 and about 3000.

22. The structure of claim 18, wherein at least one of the sub-layers of the magneto-dielectric layer is formed by ordered arrangements of metallic inclusions in a dielectric medium.

23. The structure of claim 17, further comprising:

a substrate that includes at least one of the first or the second conductive surfaces, and configured to accommodate the first anisotropic magneto-dielectric layer.

24. The structure of claim 23, further comprising a conductive surface disposed so as to connect the peripheries of the first and second conductive surfaces.

25. The structure of claim 23, sized and dimensioned to form one of a microwave or millimeterwave integrated circuit (MMIC) package.

26. The structure of claim 17, further comprising a second anisotropic magneto-dielectric layer, a second sub-layer of the second anisotropic layer disposed adjacent to one of the first or the second conductive surface and the second sub-layer of the first anisotropic dielectric layer disposed adjacent to the other one of the first or second conductive surface, and the isotropic dielectric layer disposed between the first and the second anisotropic magneto-dielectric layers.

27. The structure of claim 26, wherein each of the sub-layers of the magneto-dielectric layers is characterizable as having a layer tensor relative permittivity and a layer tensor relative permeability, each said layer tensor permittivity and layer tensor permeability having non-zero elements on the main diagonal with x and y tensor directions being in-plane of the layer and the z tensor direction being normal to the layer surface.

28. The structure of claim 27, wherein the second sub-layer of the second anisotropic magneto-dielectric layer has an effective relative permittivity in the z tensor direction that is negative over a frequency band of suppression of electromagnetic waves.

29. The structure of claim 27, wherein the first sub-layer of the second anisotropic magneto-dielectric layer faces the isotropic layer and has a relative permittivity in the x and y tensor directions which are positive and greater than unity over the frequency band of suppression.

30. The structure of claim 26, further comprising:

a substrate that includes at least one of the first or the second conductive surfaces, and configured to accommodate at least one of the first or the second anisotropic magneto-dielectric layers.

31. The structure of claim 30, further comprising a conductive surface disposed so as to connect the peripheries of the first and second conductive surfaces.

32. The structure of claim 30, sized and dimensioned to form one of a microwave or a millimeterwave integrated circuit (MMIC) package.

33. A method for controlling parallel-plate waveguide (PPW) modes in a shielded electronic package, the method comprising:

providing a first and a second conductive surface sized and dimensioned to form part of a electronic circuit package;

disposing a first and a second dielectric layer between the first and second conductive surfaces, at least one of the first or the second dielectric layers including an array of conductive structures formed therein, and selecting the dimensions of conductive structures of the array of conductive structures such that the propagation of a transverse magnetic (TM) wave is controlled in at least one of amplitude or phase over a frequency interval, wherein the shape of at least one of the conductive structures comprises a first via having a first cross sectional shape, connected to a second via having a second cross sectional shape, and where the first and second cross sectional shapes have different sizes, and the first via is characterized by an aspect ratio less than one, and the second via is characterized by a higher aspect ratio, and the length of the low aspect ratio via is at least 15% of the total length of both vias.

34. The method of claim 33, wherein the first and the second dielectric layers have the same relative permittivity.

35. The method of claim 33, wherein a third dielectric layer is disposed between the first and the second dielectric layer.

36. The method of claim 33, wherein the relative permittivity of the first dielectric and the second dielectric layers is between 1 and about 12.

37. The method of claim 33, wherein conductive structures of the array of conductive structures are sized, shaped and spaced so that, in combination with the relative permittivity of the at least one dielectric layer having the array of conductive structures therein, an electromagnetic band gap (EBG) is formed.

38. A method for controlling parallel-plate waveguide (PPW) modes, the method comprising:

providing a first conductive surface, and a second conductive surface, disposed parallel to the first conductive surface; the first conductive surface and the second conductive surface forming a part of a electronic circuit package;

providing a first anisotropic magneto-dielectric layer comprising a first sub-layer and a second sub-layer and an isotropic dielectric layer wherein the first anisotropic magneto-dielectric layer and the isotropic dielectric layer are disposed between the first conductive surface and the second conductive surface;

selecting the thickness of the first sub-layer and the second sub-layer, the permittivity and permeability of the first sub-layer and the second sub-layer, and the thickness and dielectric constant of the isotropic dielectric layer such that a transverse magnetic (TM) wave amplitude is suppressed over a frequency interval, wherein the first and the second sub-layers are periodic rodded media, and a unit cell of the rodded media has a conductive structure formed within each of the first and the second sub-layers; the conductive structure in the first sub-layer having a first cross section; the conductive structure in the second sub-layer having a second cross section, such that the first cross section has an aspect ratio of less than one and the second cross section has a higher aspect ratio, and a length of the conductive structure in the first sub-layer is at least 15% of a total length of the conductive structures in the first and the second sub-layers.

* * * * *